US010003126B2

(12) United States Patent
Sotzing

(10) Patent No.: US 10,003,126 B2
(45) Date of Patent: Jun. 19, 2018

(54) STRETCHABLE ORGANIC METALS, COMPOSITION, AND USE

(71) Applicant: THE UNIVERSITY OF CONNECTICUT, Farmington, CT (US)

(72) Inventor: Gregory Allen Sotzing, Storrs, CT (US)

(73) Assignee: THE UNIVERSITY OF CONNECTICUT, Farmington, CT (US)

( * ) Notice: Subject to any disclaimer, the term of this patent is extended or adjusted under 35 U.S.C. 154(b) by 103 days.

(21) Appl. No.: 15/135,898

(22) Filed: Apr. 22, 2016

(65) Prior Publication Data

US 2016/0315380 A1 Oct. 27, 2016

Related U.S. Application Data

(60) Provisional application No. 62/151,457, filed on Apr. 23, 2015.

(51) Int. Cl.
*H01Q 1/36* (2006.01)
*D06M 11/45* (2006.01)
(Continued)

(52) U.S. Cl.
CPC ..... *H01Q 1/368* (2013.01); *D06M 11/45* (2013.01); *D06M 11/46* (2013.01); *D06M 11/73* (2013.01);
(Continued)

(58) Field of Classification Search
CPC ..... H01B 1/127; H01B 1/122; H01B 1/128; D06N 2209/041; D06N 7/00; B05D 1/005;
(Continued)

(56) References Cited

U.S. PATENT DOCUMENTS 4,983,814 A 1/1991 Ohgushi et al.
5,830,529 A 11/1998 Ross
(Continued)

FOREIGN PATENT DOCUMENTS

JP 2008138300 A 6/2008
JP 2008179923 A 8/2008
(Continued)

OTHER PUBLICATIONS

Hair, M.L., "Hydroxyl groups on silica surface," J. Non-Crystalline Solids, 19, 1975, Abstract.*
(Continued)

*Primary Examiner* — Mark Kopec
*Assistant Examiner* — Jaison P Thomas
(74) *Attorney, Agent, or Firm* — Cantor Colburn LLP

(57) ABSTRACT

Disclosed are stretchable electrically conductive structure comprising a stretchable insulating substrate comprising nucleophile derivatized nanoparticles located at the surface of the stretchable insulating substrate, wherein the stretchable insulating substrate is a fiber or fabric; and a conducting polymer: template polymer coating disposed on at least a portion of a surface of the stretchable insulating substrate through which a chemical bond forms between at least one anion of the template polymer and nucleophile derivatized nanoparticles located at the surface of the stretchable insulating substrate.

21 Claims, 5 Drawing Sheets

(51) Int. Cl.

| | |
|---|---|
| ***D06M 11/46*** | (2006.01) |
| ***D06M 11/73*** | (2006.01) |
| ***D06M 11/79*** | (2006.01) |
| ***D06M 15/19*** | (2006.01) |
| ***D06M 23/08*** | (2006.01) |
| ***H01B 1/12*** | (2006.01) |
| ***H01Q 1/38*** | (2006.01) |
| ***D06N 7/00*** | (2006.01) |
| ***H01Q 1/27*** | (2006.01) |

(52) U.S. Cl.
CPC ..... *D06M 11/79* (2013.01); *D06M 15/19* (2013.01); *D06M 23/08* (2013.01); *D06N 7/00* (2013.01); *H01B 1/127* (2013.01); *H01Q 1/273* (2013.01); *H01Q 1/38* (2013.01); *D06N 2209/041* (2013.01)

(58) Field of Classification Search
CPC ... B05D 1/02; B05D 1/18; B05D 1/30; B05D 3/142; C09D 5/24; D06M 11/45; D06M 11/46; D06M 11/73; D06M 11/79; D06M 15/19; D06M 23/08; D06M 2209/041; H01Q 1/273; H01Q 1/368; H01Q 1/38
See application file for complete search history.

(56) References Cited

U.S. PATENT DOCUMENTS

| | | | |
|---|---|---|---|
| 6,072,619 | A | 6/2000 | Kiryuschev et al. |
| 6,103,640 | A | 8/2000 | Yoshikawa et al. |
| 6,184,280 | B1 | 2/2001 | Shibuta |
| 6,919,105 | B2 | 7/2005 | Xue et al. |
| 7,321,012 | B2 | 1/2008 | Sotzing |
| 7,413,802 | B2 | 8/2008 | Karayianni et al. |
| 7,455,935 | B2 | 11/2008 | Abe et al. |
| 7,740,656 | B2 | 6/2010 | Mensah et al. |
| 8,107,153 | B2 | 1/2012 | Sotzing et al. |
| 8,178,629 | B2 | 5/2012 | Sotzing et al. |
| 9,644,313 | B2 | 5/2017 | Sotzing |
| 2001/0045547 | A1 | 11/2001 | Senecal et al. |
| 2005/0137542 | A1 | 6/2005 | Underhill et al. |
| 2005/0237594 | A1 | 10/2005 | Ho et al. |
| 2005/0255139 | A1 | 11/2005 | Hurd et al. |
| 2006/0112599 | A1 | 6/2006 | Braynock et al. |
| 2006/0159907 | A1 | 7/2006 | Percec et al. |
| 2006/0263553 | A1 | 11/2006 | Yamada et al. |
| 2006/0281382 | A1 | 12/2006 | Karayianni et al. |
| 2007/0042179 | A1 | 2/2007 | Karayianni et al. |
| 2007/0054577 | A1 | 3/2007 | Avloni |
| 2007/0065586 | A1 | 3/2007 | Tao et al. |
| 2007/0078324 | A1 | 4/2007 | Wijisiriwardana |
| 2007/0089845 | A1 | 4/2007 | Sotzing et al. |
| 2007/0100666 | A1 | 5/2007 | Stivoric et al. |
| 2007/0215232 | A1 | 9/2007 | Hassonjee et al. |
| 2007/0222909 | A1 | 9/2007 | Slikkerveer et al. |
| 2008/0058633 | A1 | 3/2008 | Boyden et al. |
| 2008/0170982 | A1 | 7/2008 | Zhang et al. |
| 2008/0318002 | A1 | 12/2008 | Burr et al. |
| 2009/0005748 | A1 | 1/2009 | Ales et al. |
| 2010/0028559 | A1 | 2/2010 | Yan et al. |
| 2010/0163283 | A1 | 7/2010 | Hamedi et al. |
| 2010/0245971 | A1 | 9/2010 | Sotzing et al. |
| 2010/0294335 | A1 | 11/2010 | Huang et al. |
| 2011/0027869 | A1 | 2/2011 | Hatton et al. |
| 2011/0168951 | A1 | 7/2011 | Sotzing |
| 2011/0304964 | A1 | 12/2011 | Fleischer et al. |
| 2011/0315204 | A1 | 12/2011 | Gleason et al. |
| 2011/0317240 | A1 | 12/2011 | Sotzing et al. |
| 2012/0153236 | A1 | 6/2012 | Cakmak et al. |
| 2012/0164429 | A1 | 6/2012 | Shah et al. |
| 2012/0224247 | A1 | 9/2012 | Sotzing et al. |
| 2012/0274616 | A1 | 11/2012 | Scribner et al. |
| 2014/0011004 | A1 | 1/2014 | Sotzing et al. |
| 2015/0017421 | A1 | 1/2015 | Sotzing |
| 2016/0258110 | A1 | 9/2016 | Alamer |
| 2016/0312044 | A1 | 10/2016 | Sotzing |
| 2017/0018326 | A1 | 1/2017 | Sotzing et al. |

FOREIGN PATENT DOCUMENTS

| | | | |
|---|---|---|---|
| WO | 0057238 | A1 | 9/2000 |
| WO | 2006051380 | A1 | 5/2006 |
| WO | 2006051384 | A1 | 5/2006 |
| WO | 2007008977 | A1 | 1/2007 |
| WO | 2007008978 | A2 | 1/2007 |
| WO | 2007099889 | A1 | 7/2007 |
| WO | 2008066458 | A1 | 6/2008 |
| WO | 2008098136 | A1 | 8/2008 |
| WO | 2009025849 | A1 | 2/2009 |
| WO | 2010022353 | A1 | 2/2010 |
| WO | 2010114718 | A1 | 10/2010 |
| WO | 20100141743 | A1 | 12/2010 |

OTHER PUBLICATIONS

Xia, Y. & Ouyang, J. PEDOT:PSS films with significantly enhanced conductivities induced by preferential solvation with cosolvents and their application in polymer photovoltaic cells. J. Mater. Chem. 21, 4927-4936 (2011).

Xia, Y. & Ouyang, J. Significant Conductivity Enhancement of Conductive Poly(3,4-ethylenedioxythiophene): Poly (styrenesulfonate) Films through a Treatment with Organic Carboxylic Acids and Inorganic Acids, ACS Appl. Mater, Interfaces 2, 474-483 (2010).

Yamashita (2013) Fabrication and evaluation of a conductive polymer coated ealstomer contact structure for woven electronic textile. Sensors and Actuators A: Physical, 195, pp. 213-218.

Crispin et al., "Conductivity, Morphology, Interfacial Chemistry, and Stability of Poly(3,4-ethylene dioxythiophene)-Poly (styrene sulfonate): A Photoelectron Spectroscopy Study", Journ. of Polym. Sci. Part B: Polymer Physics, vol. 41, No. 21, Nov. 11, 2003.

International Search Report; International Application No. PCT/US2016/028248; International Filing Date Apr. 19, 2016; dated Jun. 21, 2016; 6 pages.

International Search Report; International Application No. PCT/US2016/028815; International Filing Date Apr. 22, 2016; dated Jul. 14, 2016; 6 pages.

Suh et al., Effect of Fabric Substrate and Coating Material on the Quality of Conductive Printing, The Journal of the Textile Institute, 2013, vol. 104, No. 2, 213-222.

Wang et al., Effect of Silica Nanoparticle Content on the Structure and Electrostatic Bonding of PEDOT:PSS, Mol. Cryst. Liq. Cryst., vol. 568: pp. 179-185, 2012.

Written Opinion of the International Searching Authority; International Application No. PCT/US2016/028248; International Filing Date Apr. 19, 2016; 7 pages.

Written Opinion of the International Searching Authority; International Application No. PCT/US2016/028815; International Filing Date Apr. 22, 2016; 6 pages.

"All Organic Electrochromic Spandex", Department of Chemistry and the Polymer Program, University of Connecticut, Storrs, Connecticut, USA, pp. 296-300, including supplemental and supporting information; 2010 American Chemical Society; vol. 2, No. 1.

"Electrochemical Study of Dual Conjugated Polymer Electrochromic Devices", Journal of Electroanalytical Chemistry (2007), 609(2), 75-84.

"High Contrast Solid-State Electrochromic Devices from Substituted 3, 4-Propylenedloxythiophenes Using the Dual Conjugated Polymer Approach", Synthetic Metals (2007), 157(6-7), 261-268.

"Maximum Contrast from an Electrochromic Material", Electrochemistry Communications (2007), 9(8), 1931-1935.

"Optimization, Preparation, and Electrical Short Evaluation for 30 cm2 Active Area Dual Conjugated Polymer Electrochromic Windows", Organic Electronics (2007), 8(4), 367-381.

"Rapid Switching Solid State Electrochromic Devices Based on Complementary Conducting Polymer Films", Polymer Films (Weinheim, Germany) (1996), 8(10), 808-811.

(56) References Cited

OTHER PUBLICATIONS

"The Effects of Colored Base Fabric on Electrochromic Textile", University of Connecticut, Department of Chemistry and the Polymer Program, Storrs, Connecticut, USA, pp. 1-16, Jan. 4, 2010.
"Unique Variable-Gap Polyheterocycles for High-Contrast Dual Polymer Electrochromic Devices", Synthetic Metals (1997), 85(1-3), 1295-1298.
Coating Guide Clevios TM P Formulations, 1-12 (2012) http://www.heraeus-clevios.com/media/webmedia_local/media/datenblaetter/Clevios_P_coating_guide_08-03-18jb2.pdf.
D. Alemu, H.Y. Wei, K.-C. Ho, C.-W. Chu, Energy Environ. Sci. 2012, 5, 9662.
R. K. Hiremath, M. K. Rabinal, B. G, Mulimani, Rev. Sci, Instrum, 2006, 77, 126106.
"Preparation of conductive graphene/graphite Infused fabrics using an Interface trapping method" Steven J Woltornist et al. , Carbon, vol. 81, 38-42 (2015) available online Sep. 19, 2014.
ADIPRENE DURACAST E900, Chemtura Technical Information, Oct. 20, 2008, 4 pages.
Aleshin, A., Klebooms, R., Menon, R. & Heeger, A, J, Electronic transport in doped poly (3,4-ethylenedioxythlophene) near the metal-insulator transition, Synth. Met. 90, 61-68 (1997).
ChemFiles, Enabling Technologies, Ionic Liquids, vol. 5 No. 6 (2005) 24 pages.
Ding, "Conductivity trends of PRDOT-PSS Impregnated fabric and the effect of conductivity on electrochromic textile", UCONN, Department of Chemistry and the Polymer Program pp. 1-20.
DURACURE C3, Chemtura Technical Information, Sep. 8, 2008, 6 pages.
Electrically controlled colour-changing textiles using the resistive heating properties of PEDOT nanofibers Laforgue, A, 2010 Journal of Materials Chemistry 20 (38) , pp. 8233-8235.
European Search Report for Application No. PCT/US2012023282 dated Jan. 5, 2015, 11 pages.
Fahad (2013) Thesis Ch. 6-7, pp. 129-182.
Fuest, Polyurethane Elastomers, Rubber Technology, 2001, 24 pages.
Groenendaal, B. L., Jonas, F., Freitag, D., Pielartzik, H. & Reynolds, J. R. Its Derivatives□: Past , Present , and Future **, Adv. Mater. 12, 481-494 (2000).
International Search Report for Application No. PCT/US2010/027956, dated Jun. 7, 2010, 7 pages.
International Search Report for Application No. PCT/US2014/044529, International Filing date Jun. 27, 2014, dated Nov. 6, 2014, 5 pages.
International Search Report for International Application No. PCT/US2012/023282, International Application Filing Date Jan. 31, 2012, dated Aug. 30, 2012, 3 pages.
Kim, N. et al. Highly conductive PEDOT:PSS nanofibrils Induced by solution-processed crystallization. Adv. Mater. 26, 2268-72, 2109 (2014).
Lee (2013) Flexible graphene woven fabrics for touch sensing. Applied Physics Letters, 102 (16), 163117; 5 pages.
Li et al., "Synthesis and characterization of mixing sof-segmented waterborne polyurethane polymer electrolyte with room temperature ionic liquid", Chinese Chemical Letters 20, 2009, pp. 519-522.
Lomax, "Breathable polyurethane membranes for textile and related Industries", J. Mater. Chem. 17, 2007, pp. 2775-2784.
Materials Research Society, 2011 Spring Meeting, Online Abstract Feb. 1, 2011, 1 page.
McCulloch, I. et al. Liquid-crystalline semiconducting polymers with high charge-carrier mobility, Nat. Mater. 5, 328-33 (2006).
Mengistie, D. A., Ibrahem, M. A., Wang, P.-C. & Chu, C.-W. Highly Conductive PEDOT:PSS Treated with Formic Acid for ITO-Free Polymer Solar Cells. ACS Appl. Mater. Interfaces 6, 2292-2299 (2014).
Molina (2013) Electrochemical characterization of reduced graphene oxide-coated polyester fabrics. Electrochimica Acta, 93, pp. 44-52.
Nardes, A. M., Janssen, R. a. J. & Kemerink, M. A Morphological Model for the Solvent-Enhanced Conductivity of PEDOT:PSS Thin Films, Adv. Funct. Mater. 18, 865-871 (2008).
Negru (2012) Electrical conductivity of woven fabrics coated with carbon black particles. Fibers and Textiles. 20(1 (90)), pp. 53-56.
Okuzaki, WIPO Publication No. WO2007099889A1_Abstract of published PCT Application No. PCT/JP2007/053467 filed on Feb. 26, 2007 and published on Sep. 7, 2007, 1 page.
Ouyang, J. et al. On the mechanism of conductivity enhancement in poly(3,4-ethylenedioxythiophene):poly(styrene sulfonate) film through solvent treatment. Polymer (Guildf). 45, 8443-8450 (2004).
Reynolds, (1996) Controlled gap polymers for high contrast electrochromic devices, Polymeric Materials Science and Engineering, 75 pp. 414-415.
Rowley et al., "New Electrochromic Materials", Science Progress (2002), 85 (3), 243-262.
Rymarczyk et al., "A novel ternary polymer electrolyte for LMP batteries based on thermal cross-linked poly (urethane acrylate) in presence of a lithium salt and an ionic liquid", European Polymer Journal 44, 2008, pp. 2153-2161.
Santhosh et al., "Preparation and properties of new cross-linked polyurethane acrylate elctrolytes for lithium batteries", Journal of Power Sources 160, 2006, pp. 609-620.
Seiko Epson Corp, JP2008179923, Abstract, Aug. 7, 2008, 2 pages.
Seok-Joo Wang (2012): Effect of Silica Nanoparticle Content on the Structure and Electrostatic Bonding of PEDOT: PSS, Molecular Crystals and Liquid Crystals, 568:1, 179-185.
Shateri-Khalilabad (2013) Fabricating electroconductive cotton textiles using graphene. Carbohydrate polymers, 96(1), 190-5, 6 pages.
Skotheim et al., "Handbook of Conducting Polymers", 3rd Ed., 2007, 67 pages.
Written Opinion for Application No. PCT/US2015/044529, International filing date Jun. 27, 2014, dated Nov. 6, 2014, 7 pages.
Written Opinion for International Application No. PCT/US2012/023282, International Application Filing Date Jan. 31, 2012, dated Aug. 30, 2012, 5 pages.
Written Opinion of International Search Report for PCT/US2010/027956, dated Jun. 7, 2010, 7 pages.
International Preliminary Report on Patentability for International Application No. PCT/US2016/028815, International Filing Date Apr. 22, 2016, dated Nov. 2, 2017, 7 pages.

* cited by examiner

STRETCHABLE ORGANIC METALS, COMPOSITION, AND USE

CROSS-REFERENCE TO RELATED APPLICATIONS

This application claims the benefit of U.S. Provisional Application Ser. No. 62/151,457, filed Apr. 23, 2015, which is incorporated herein by reference in its entirety.

BACKGROUND

Electrically conductive fabrics are known and are typically prepared by infusing metals into the textile. However, this method for imparting conductivity to the fabric suffers from such issues as loss of fabric flexibility and weight increase due to high weight percent loading. Further, the metals on the textile surface can result in toxic effects and/or allergic reactions when in contact with the skin of the wearer of the fabric.

There remains a need in the art for new, electrically conductive fabrics and textiles which retain flexibility and stretchability and are safer to use.

BRIEF SUMMARY

In one embodiment, a stretchable electrically conductive structure comprises a stretchable insulating substrate comprising nucleophile derivatized nanoparticles located at the surface of the stretchable insulating substrate, wherein the stretchable insulating substrate is a fiber or fabric; and a conducting polymer:template polymer coating disposed on at least a portion of a surface of the stretchable insulating substrate through which a chemical bond forms between at least one anion of the template polymer and nucleophile derivatized nanoparticles located at the surface of the stretchable insulating substrate; optionally wherein the stretchable electrically conductive structure comprises a conductive organic particle disposed between the stretchable insulating substrate and the conducting polymer:template polymer coating.

In another embodiment, a method of making a stretchable electrically conductive structure, comprises providing a stretchable insulating substrate comprising nucleophile derivatized nanoparticles located at the surface of the stretchable insulating substrate, wherein the stretchable insulating substrate is a fiber or fabric; forming a conducting polymer:template polymer coating on at least a portion of a surface of the stretchable insulating substrate to form a stretchable electrically conductive structure, optionally further wherein the stretchable insulating substrate is plasma treated before the forming the conducting polymer:template polymer coating.

DETAILED DESCRIPTION

Disclosed herein are stretchable organic metals, more specifically organic stretchable electrically conductive structures exhibiting metallic properties. The stretchable electrically conductive structures comprise a stretchable insulating substrate comprising nucleophile derivatized nanoparticles located at the surface of the stretchable insulating substrate and a conducting polymer:template polymer coating disposed on at least a portion of a surface of the stretchable insulating substrate through which a chemical bond forms between at least one anion of the template polymer and nucleophile derivatized nanoparticles located at the surface of the stretchable insulating substrate. The stretchable insulating substrate can be a stretchable fiber or stretchable fabric. It has been surprisingly found that the conducting polymer:template polymer coating of the stretchable electrically conductive structure has the ability to stretch along with the stretchable insulating substrate, whereas the conducting polymer alone will only tear. The stretchable electrically conductive structure has the ability to be stretched and retain its metal-like properties with respect to its temperature characteristics, ohmic behavior, and high charge carrier mobilities and concentrations.

In these structures, the coating of conducting polymer:template polymer material is phase separated such that there is a higher concentration of template polymer at the interface of the surface of the stretchable insulating substrate and the coating of conducting polymer:template polymer material. Not wishing to be bound by theory, it is proposed that a small amount of 'leaving group' or 'nucleophile' derivatized nanoparticle present at the surface of the stretchable insulating substrate reacts with the template polymer, e.g. polystyrenesulfonic acid, polyvinylphoshoric acid, etc. used as a counterion for the conducting polymer, to form covalent bonds at the particle surface that induce a phase segregation of the template polymer from the conducting polymer. This phase segregation generates a gradient of ratios of Template Polymer:Conducting Polymer, with the highest amount of Template Polymer:Conducting polymer occurring at the interface of the substrate and the Template Polymer:Conducting polymer film. Thus, there is a gradient by which most of the conducting polymer is at the surface of the film of conducting polymer:template polymer material, and away from the substrate surface.

Figure 1:
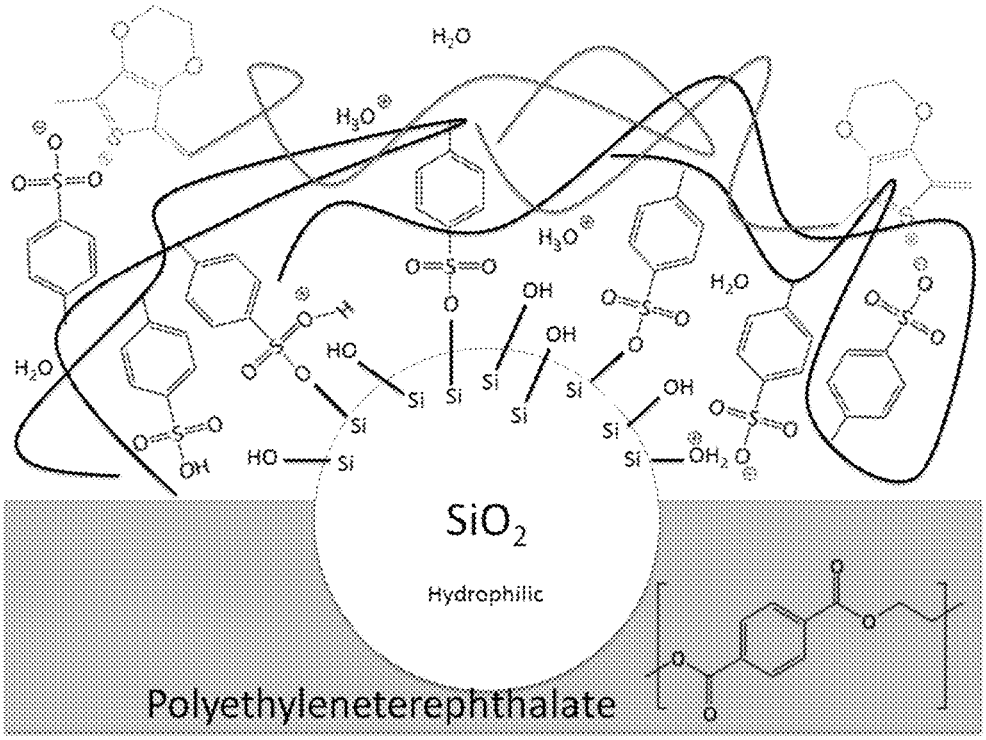
FIG. 1 is a schematic of the proposed phase segregation of PEDOT:PSS based on chemical reaction of the PSS with silica nanoparticles at the surface of a PET substrate.

FIG. 1 depicts the proposed phase segregation of PEDOT:PSS and is not to scale. The substrate is polyethyleneterephthalate (PET) comprising particles of silica at the surface (a single $SiO_2$ nanoparticle is shown). The PSS reacts with the Si-OH groups of the silica to form covalent bonds, thus resulting in a higher concentration of PSS at the interface of the PET substrate and PEDOT:PSS film and a higher concentration of PEDOT furthest from this interface. Not wishing to be bound by theory, but it is possible that the phase segregation occurs as the nucleophile derivatized nanoparticle is in a solid phase and the template polymer is in solution; and it is surprising that such a chemical reaction would take place and induce a phase separation phenomenon.

The stretchable electrically conductive structure exhibits certain mechanical properties, e.g. elasticity, as well as a certain ionic conductivity, even upon stretching and repeated stretching. The stretchable electrically conductive structure is both flexible and expandable owing to the stretchable insulating substrate.

Stretchability for a given material can be characterized by elongation at break and the ability of elastic recovery. Elastomeric material such as Spandex, have a large elongation at break value (up to about 800% to about 900%) and recover to their original form when the force is removed within a certain range. Different fabrics have different stretchablility depending on the type, fiber/yarn diameter, fiber bundle, etc. In general, common fabrics, such as silk or cotton, have little to no stretchability as compared to Spandex. However, there are many commercially available products which contain small amount of Spandex (about 5-15%) that have sufficient stretchability for use as stretchable insulating substrates herein.

It has further surprisingly been found that the stretchable electrically conductive structure comprising the conducting polymer:template polymer coating is washable. "Washable" means that the stretchable electrically conductive structure has the ability to maintain functionality and not be damaged after being soaking in water or other suitable solvent with or without laundrydetergent/soap and/or agitation, followed by an optional rinsing step and subsequent drying or removal of the solvent. In one embodiment, the washable stretchable electrically conductive structure further comprises a hydrophobic fabric treatment, for example Scotchgard™ Fabric & Upholstery Protector, perfluorinated alkylsulfonate (e.g. wherein the "alkyl" is a $C_4$-$C_9$), perfluorinated urethanes, and the like.

The stretchable insulating substrate can be a stretchable fiber or stretchable fabric comprising nucleophile derivatized nanoparticles located at least at the surface of the stretchable insulating substrate.

The term "fiber" as used herein includes single filament and multi-filament fibers, i.e., fibers spun, woven, knitted, crocheted, knotted, pressed, plied, or the like from multiple filaments. No particular restriction is placed on the length of the fiber, other than practical considerations based on manufacturing considerations and intended use. Similarly, no particular restriction is placed on the width (cross-sectional diameter) of the fibers, other than those based on manufacturing and use considerations. The width of the fiber can be essentially constant, or vary along its length. For many purposes, the fibers can have a largest cross-sectional diameter of 2 nanometers and larger, for example up to 2 centimeters, specifically from 5 nanometers to 1 centimeter. In an embodiment, the fibers can have a largest cross-sectional diameter of 5 to 500 micrometers, more particularly, 5 to 200 micrometers, 5 to 100 micrometers, 10 to 100 micrometers, 20 to 80 micrometers, or 40 to 50 micrometers. In one embodiment, the fiber has a largest circular diameter of 40 to 45 micrometers. Further, no restriction is placed on the cross-sectional shape of the fiber, providing the desirable properties such as flexibility and/or stretchability are not adversely affected. For example, the fiber can have a cross-sectional shape of a circle, ellipse, square, rectangle, or irregular shape.

The stretchable fabric can be woven or non-woven fabric comprising fibers of stretchable polymeric material.

The stretchable insulating substrate can be a stretchable fiber or stretchable fabric. The stretchable insulating substrate comprises nucleophile derivatized nanoparticles at the substrate surface. The term "substrate comprising nucleophile derivatized nanoparticles at the substrate surface" is synonomous with the term "substrate comprising surface nucleophile derivatized nanoparticles". Further as used herein, the term "surface nucleophile derivatized nanoparticles" is synonomous with "surface nanoparticles".

Suitable stretchable insulating substrate materials include stretchable polymeric material. Exemplary stretchable polymeric material include polyurethane, polyester-polyurethane copolymer (e.g. Spandex), and blends of polyurethane or polyester-polyurethane and an additional synthetic organic polymer e.g., polyacrylic, polyamide (nylon), polycarbonate, polyether, polyester (e.g. polyethyleneterephthalate), polyethylene, polyimide, polyurethane, polyester-polyurethane copolymer, polyurea, polythiourea, polysiloxane, polyisoprene, polybutadiene, polyethylene oxide, polylactic acid blends thereof, copolymers thereof and the like. In another embodiment, fabrics prepared from a combination of stretchable fibers (e.g., polyester-polyurethane (Spandex)) fibers and other fibers (e.g. synthetic organic polymers or natural materials (e.g., cotton, silk, and wool)) can be used as long as the overall fabric is stretchable.

The nucleophile derivatized nanoparticles can be nanoparticulate inorganic oxide such as silicon dioxide ($SiO_2$), titanium dioxide ($TiO_2$), aluminum oxide, calcium oxide, amine functionalized nanoparticles, or a combination thereof. The nucleophile derivatized nanoparticles can have an average particle size of about 1 nanometer (nm) to about 1000 nm, specifically about 5 nm to about 500 nm, and more specifically about 10 nm to about 200 nm. In an embodiment, the nucleophile derivatized nanoparticles have an average particle size measured by transmission electron microscopy of about 10 nm, with a distribution of about 8 to about 12 nm.

The nucleophile derivatized nanoparticles can be present in an amount of about 0.01 to about 6.0 wt % by weight of the stretchable insulating substrate comprising nucleophile derivatized nanoparticles, specifically about 0.05 to about 5.0 wt. %, and more specifically about 0.1 to about 4.0 wt % by weight of the stretchable insulating substrate comprising nucleophile derivatized nanoparticles.

The nucleophile derivatized nanoparticles can be present on the surface of the stretchable insulating substrate in an amount of about 0.01 to about 6.0% area relative to the total surface area of the stretchable insulating substrate comprising nucleophile derivatized nanoparticles, specifically about 0.05 to about 5.0% area, and more specifically about 0.1 to about 4.0% area relative to the total surface area of the stretchable insulating substrate comprising nucleophile derivatized nanoparticles.

The stretchable insulating substrate comprising surface nucleophile derivatized nanoparticles can be of any thickness. For those applications that require flexibility and/or stretchability, the thickness of the stretchable insulating substrate comprising surface nucleophile derivatized nanoparticles can be about 100 nm to about 1 centimeter (cm), specifically about 500 nm to about 0.1 cm, more specifically about 1 micrometer to about 5 millimeter (mm). In an embodiment, a stretchable insulating substrate can have a thickness of about 1 micrometer to about 5 mm.

The nucleophile derivatized nanoparticles can be present at the substrate surface in a random pattern or an organize pattern or design. The nucleophile derivatized nanoparticles are present at least embedded at the surface of the substrate where at least a portion of the nanoparticle is exposed, and optionally further distributed within the substrate material itself Nucleophile derivatized nanoparticles are incorporated into the stretchable insulating substrate such that the nanoparticles are exposed to the surface. Treatment, such as plasma treatment, can further expose the nanoparticles as well as generate a more polar polymer surface. Plasma treatment can be conducted using processes and process conditions well known in the art. The nucleophile derivatized nanoparticle serves as nucleation sites and allow growth or have segregation better achieved by polarity induced on polymer due to plasma treatment.

To form the substrate comprising surface nucleophile derivatized nanoparticles, the nanoparticles can be incorporated into a substrate material any number of ways. In one embodiment, the substrate material is combined with nanoparticles at or slightly above the melt temperature of the substrate material and blended with high shear to ensure no clustering of the nanoparticles. The resulting melt can be processed via conventional melt processing, melt spinning, and/or extrusion techniques known in the art.

In another embodiment, the nanoparticles can be applied to a substrate via a deposition technique. For example, silica nanoparticles having exposed hydroxyl functionality could be 'blown' onto a PET/Spandex substrate, and then the nanoparticles could undergo a transesterification with the PET that would covalently link the silica particles and anchor them to the PET/Spandex substrate surface.

The conducting polymer film structure comprises a conducting polymer:template polymer film disposed on at least a portion of the surface of the stretchable insulating substrate comprising surface nucleophile derivatized nanoparticles. In an alternative embodiment, the conducting polymer:template polymer coating is in the form of a pattern on at least a portion of the surface of the stretchable insulating substrate.

A conducting polymer:template polymer coating can be formed on the stretchable insulating substrate comprising surface nanoparticles using any variety of techniques known in the art. For example, a PEDOT-PSS film can be formed by using solution processing techniques. The stretchable insulating substrate can be soaked with a dispersion of PEDOT-PSS in a suitable solvent followed by drying and/or annealing. Other suitable processes include drop casting, tape casting, flow coating, spray coating, etc. The annealing can be conducted at temperatures of about 80 to about 130° C., specifically about 90 to about 125° C., and yet more specifically about 100 to about 120° C. for as long as needed. Such conditions can be carried out in an oven or other suitable apparatus with or without vacuum or air flow.

Conducting polymers are known in the art and are often complexed with a template polymer, e.g. polystyrenesulfonic acid, polyvinylphoshoric acid, etc. where the sulfate or phosphonate, etc. serve as the counterion for the conducting polymer that possess positive charges as the charge carrier.

Conducting polymers include those conducting polymers comprising units of conducting monomers, e.g. where the conducting polymer is prepared by template polymerization. Examples of suitable conducting monomers include those known in the art to exhibit electroactivity when polymerized, including but not limited to thiophene, substituted thiophene, 3,4-ethylenedioxythiophene, thieno[3,4-b]thiophene, substituted thieno[3,4-b]thiophene, dithieno[3,4-b:3',4'-d]thiophene, thieno[3,4-b]furan, substituted thieno[3,4-b]furan, bithiophene, substituted bithiophene, pyrrole, substituted pyrrole, phenylene, substituted phenylene, naphthalene, substituted naphthalene, biphenyl and terphenyl and their substituted versions, phenylene vinylene, substituted phenylene vinylene, aniline, substituted aniline, the monomers disclosed herein as structures (I)-(XXIX), combinations thereof, and the like.

Suitable conducting monomers include 3,4-ethylenedioxythiophene, 3,4-ethylenedithiathiophene, 3,4-ethylenedioxypyrrole, 3,4-ethylenedithiapyrrole, 3,4-ethylenedioxyfuran, 3,4-ethylenedithiafuran, and derivatives having the general structure (I):

(I)

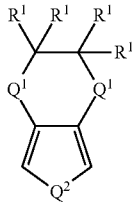

wherein each occurrence of $Q^1$ is independently S or O; $Q^2$ is S, O or N—$R^2$ wherein $R^2$ is hydrogen or $C_1$-$C_6$ alkyl; and each occurrence of $R^1$ is independently hydrogen, $C_1$-$C_{12}$ alkyl, $C_1$-$C_{12}$ alkyl-OH, $C_1$-$C_{12}$ haloalkyl, $C_1C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl. In one embodiment, each occurrence of $R^1$is hydrogen. In one embodiment, each $Q^1$ is O and $Q^2$ is S. In another embodiment, each $Q^1$ is O, $Q^2$ is S, and one $R^1$ is $C_1$-$C_{12}$ alkyl, $C_1$-$C_{12}$ alkyl-OH, $C_1$-$C_{12}$ haloalkyl, $C_1$-$C_{12}$ alkoxy, $C_1$-$C_{12}$ haloalkoxy, —$C_1$-$C_6$ alkyl-O—$C_1$-$C_6$ alkyl, while the remaining $R^1$ are hydrogen. In another embodiment, each $Q^1$ is O, $Q^2$ is S, and one $R^1$ is $C_1$ alkyl-OH, while the remaining $R^1$ are hydrogen. A specific conducting monomer is EDOT.

Another suitable conducting monomer includes an unsubstituted and 2- or 6-substituted thieno[3,4-b]thiophene and thieno[3,4-b]furan having the general structures (II), (III), and (IV):

(II)

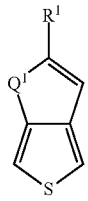

(III)

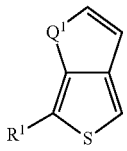

-continued (IV)

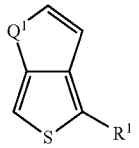

wherein $Q^1$ is S, O, or Se; and $R^1$ is hydrogen, $C_1$-$C_{12}$ alkyl, $C_1$-$C_{12}$ haloalkyl including perfluoroalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl. In one embodiment, $Q^1$ is S and $R^1$ is hydrogen. In another embodiment, $Q^1$ is O and $R^1$ is hydrogen. In yet another embodiment, $Q^1$ is Se and $R^1$ is hydrogen.

Another suitable conducting monomer includes substituted 3,4-propylenedioxythiophene (ProDOT) monomers according to the general structure (V):

(V)

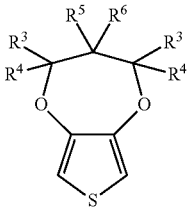

wherein each instance of $R^3$, $R^4$, $R^5$, and $R^6$ independently is hydrogen; optionally substituted $C_1$-$C_{20}$ alkyl, $C_1$-$C_{20}$ haloalkyl, aryl, $C_1$-$C_{20}$ alkoxy, $C_1$-$C_{20}$ haloalkoxy, aryloxy, —$C_1$-$C_{10}$ alkyl-O—$C_1$-$C_{10}$ alkyl, —$C_1$-$C_{10}$ alkyl-O-aryl, —$C_1$-$C_{10}$ alkyl-aryl; or hydroxyl. The $C_1$-$C_{20}$ alkyl, $C_1$-$C_{20}$ haloalkyl, aryl, $C_1$-$C_{20}$ alkoxy, $C_1$-$C_{20}$ haloalkoxy, aryloxy, —$C_1$-$C_{10}$ alkyl-O—$C_1$-$C_{10}$ alkyl, —$C_1$-$C_{10}$ alkyl-O-aryl, or —$C_1$-$C_{10}$ alkyl-aryl groups each may be optionally substituted with one or more of $C_1$-$C_{20}$ alkyl; aryl; halogen; hydroxyl; —N—$(R^2)_2$ wherein each $R^2$ is independently hydrogen or $C_1$-$C_6$ alkyl; cyano; nitro; —COOH; —S(=O)$C_0$-$C_{10}$ alkyl; or —S(=O)$_2C_0$-$C_{10}$ alkyl. In one embodiment, $R^5$ and $R^6$ are both hydrogen. In another embodiment, $R^5$ and $R^6$ are both hydrogen, each instance of $R^3$ independently is $C_1$-$C_{10}$ alkyl or benzyl, and each instance of $R^4$ independently is hydrogen, $C_1$-$C_{10}$ alkyl, or benzyl. In another embodiment, $R^5$ and $R^6$ are both hydrogen, each instance of $R^3$ independently is $C_1$-$C_5$ alkyl or benzyl and each instance of $R^4$ independently is hydrogen, $C_1$-$C_5$ alkyl, or benzyl. In yet another embodiment, each instance of $R^3$ and $R^4$ are hydrogen, and one of $R^5$ and $R^6$ is hydroxyl while the other is hydrogen.

Other suitable conducting monomers include pyrrole, furan, thiophene, and derivatives having the general structure (VI):

(VI)

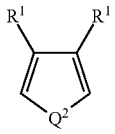

wherein $Q^2$ is S, O, or N—$R^2$ wherein $R^2$ is hydrogen or $C_1$-$C_6$ alkyl; and each occurrence of $R^1$ is independently hydrogen, $C_1$-$C_{12}$ alkyl, $C_1$-$C_{12}$ haloalkyl, alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl.

Additional conducting monomers include isathianaphthene, pyridothiophene, pyrizinothiophene, and derivatives having the general structure (VII):

(VII)

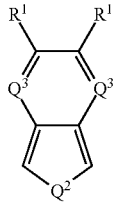

wherein $Q^2$ is S, O, or N—$R^2$ wherein $R^2$ is hydrogen or $C_1$-$C_6$ alkyl; each occurrence of $Q^3$ is independently CH or N; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl.

Still other conducting monomers include oxazole, thiazole, and derivatives having the general structure (VIII):

(VIII)

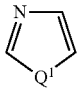

wherein $Q^1$ is S or O.

Additional conducting monomers include the class of compounds according to structure (IX):

(IX)

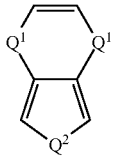

wherein $Q^2$ is S, O, or N—$R^2$ wherein $R^2$ is hydrogen or $C_1$-$C_6$ alkyl; and each occurrence of $Q^1$ is independently S or O.

Additional conducting monomers include bithiophene, bifuran, bipyrrole, and derivatives having the following general structure (X):

(X)

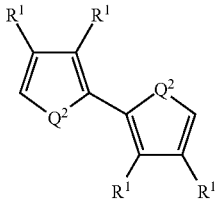

wherein each occurrence of $Q^2$ is independently S, O, or N—$R^2$ wherein $R^2$ is hydrogen or $C_1$-$C_6$ alkyl; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl.

Conducting monomers include terthiophene, terfuran, terpyrrole, and derivatives having the following general structure (XI):

(XI)

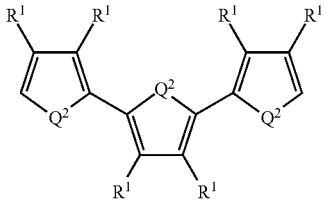

wherein each occurrence of $Q^2$ is independently S, O, or N—$R^2$ wherein $R^2$ is hydrogen or $C_1$-$C_6$ alkyl; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl.

Additional conducting monomers include thienothiophene, thienofuran, thienopyrrole, furanylpyrrole, furanylfuran, pyrolylpyrrole, and derivatives having the following general structure (XII):

(XII)

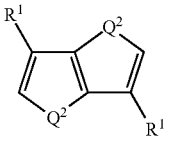

wherein each occurrence of $Q^2$ is independently S, O, or N—$R^2$ wherein $R^2$ is hydrogen or $C_1$-$C_6$ alkyl; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl.

Still other conducting monomers include dithienothiophene, difuranylthiophene, dipyrrolylthiophene, dithienofuran, dipyrrolylfuran, dipyrrolylpyrrole, and derivatives having the following general structure (XIII)

(XIII)

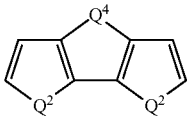

wherein each occurrence of $Q^2$ is independently S, O, or N—$R^2$ wherein $R^2$ is hydrogen or $C_1$-$C_6$ alkyl; $Q^4$ is $C(R^1)_2$, S, O, or N—$R^2$; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl, or —$C_1$-$C_6$ alkyl-O-aryl.

Additional conducting monomers include dithienylcyclopentenone, difuranylcyclopentenone, dipyrrolylcyclopentenone and derivatives having the following general structure (XIV):

(XIV)

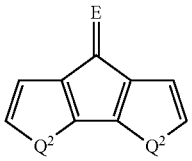

wherein each occurrence of $Q^2$ is independently S, O, or N—$R^2$ wherein $R^2$ is hydrogen or $C_1$-$C_6$ alkyl; and E is O or $C(R^7)_2$, wherein each occurrence of $R^7$ is an electron withdrawing group.

Other suitable conducting monomers include those having the following general structure (XV):

(XV)

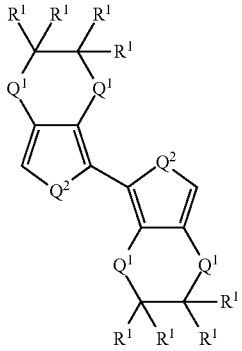

wherein each occurrence of $Q^1$ is independently S or O; each occurrence of $Q^2$ is independently S, O, or N—$R^2$ wherein $R^2$ is hydrogen or $C_1$-$C_6$ alkyl; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl. In one embodiment, each occurrence of $Q^1$ is O; each occurrence of $Q^2$ is S; and each occurrence of $R^1$ is hydrogen.

Additional conducting monomers include dithienovinylene, difuranylvinylene, and dipyrrolylvinylene according to the structure (XVI):

(XVI)

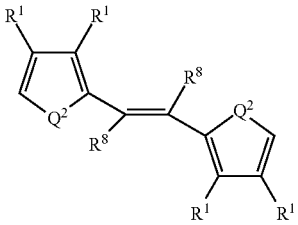

wherein each occurrence of $Q^2$ is independently S, O, or N—$R^2$ wherein $R^2$ is hydrogen or $C_1$-$C_6$ alkyl; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl; and each occurrence of $R^8$ is hydrogen, $C_1$-$C_6$ alkyl, or cyano.

Other conducting monomers include 1,2-Trans(3,4-ethylenedioxythienyl)vinylene, 1,2-trans(3,4-ethylenedioxyfuranyl)vinylene, 1,2-trans(3,4ethylenedioxypyrrolyl)vinylene, and derivatives according to the structure (XVII):

(XVII)

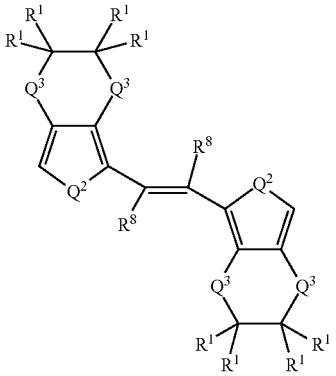

wherein each occurrence of $Q^3$ is independently $CH_2$, S, or O; each occurrence of $Q^2$ is independently S, O, or N—$R^2$ wherein $R^2$ is hydrogen or $C_1$-$C_6$ alkyl; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl; and each occurrence of $R^8$ is hydrogen, $C_1$-$C_6$ alkyl, or cyano.

Additional conducting monomers include the class bis-thienylarylenes, bis-furanylarylenes, bis-pyrrolylarylenes and derivatives according to the structure (XVIII):

(XVIII)

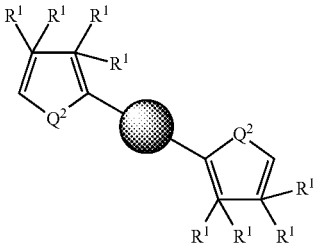

wherein each occurrence of $Q^2$ is independently S, O, or N—$R^2$ wherein $R^2$ is hydrogen or $C_1$-$C_6$ alkyl; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl; and

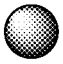

represents an aryl. Exemplary aryl groups include furan, pyrrole, N-substituted pyrrole, phenyl, biphenyl, thiophene, fluorene, 9-alkyl-9H-carbazole, and the like.

Other conducting monomers include the class of bis(3,4-ethylenedioxythienyl)arylenes, related compounds, and derivatives according to the structure (XIX):

(XIX)

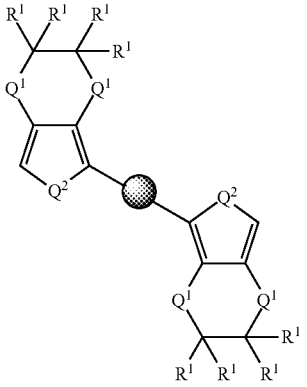

wherein each occurrence of $Q^1$ is independently S or O; each occurrence of $Q^2$ is independently S, O, or N—$R^2$ wherein $R^2$ is hydrogen or $C_1$-$C_6$ alkyl; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl; and

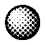

represents an aryl.

Other exemplary conducting monomers include bis(3,4-ethylenedioxythienyl)arylenes according to structure (XIX) includes the compound wherein all $Q^1$ are O, both $Q^2$ are S, all $R^1$ are hydrogen, and

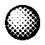

is phenyl linked at the 1 and 4 positions. Another exemplary compound is where all $Q^1$ are O, both $Q^2$ are S, all $R^1$ are hydrogen, and

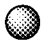

is thiophene linked at the 2 and 5 positions.

Additional conducting monomers include the class of compounds according to structure (XX):

(XX)

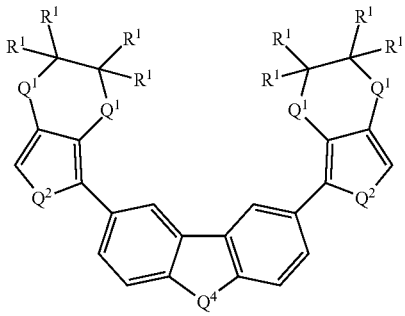

wherein each occurrence of $Q^1$ is independently S or O; each occurrence of $Q^2$ is independently S, O, or N—$R^2$ wherein $R^2$ is hydrogen or $C_1$-$C_6$ alkyl; $Q^4$ is $C(R^1)_2$, S, O, or N—$R^2$; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl. In one embodiment, each occurrence of $Q^1$ is O; each occurrence of $Q^2$ is S; each occurrence of $R^1$ is hydrogen; and $R^2$ is methyl.

Still other conducting monomers include the class of compounds according to structure (XXI):

(XXI)

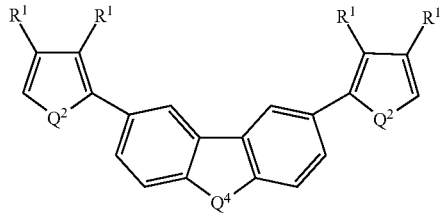

wherein each occurrence of $Q^2$ is independently S, O, or N—$R^2$ wherein $R^2$ is hydrogen or $C_1$-$C_6$ alkyl; $Q^4$ is $C(R^1)_2$, S, O, or N—$R^2$; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl.

Additional conducting monomers include the class of compounds according to structure (XXII):

(XXII)

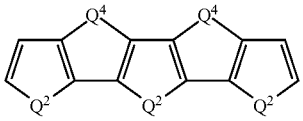

wherein each occurrence of $Q^2$ is independently S, O, or N—$R^2$ wherein $R^2$ is hydrogen or $C_1$-$C_6$ alkyl; each occurrence of $Q^4$ is $C(R^1)_2$, S, O, or N—$R^2$; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl.

Other exemplary monomers include the class of compounds according to structure (XXIII):

(XXIII)

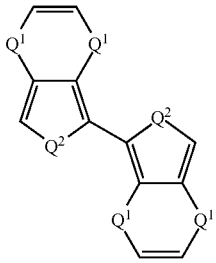

wherein each occurrence of $Q^2$ is independently S, O, or N—$R^2$ wherein $R^2$ is hydrogen or $C_1$-$C_6$ alkyl; and each occurrence of $Q^1$ is independently S or O.

Exemplary conducting monomers include the class of compounds according to structure (XXIV):

(XXIV)

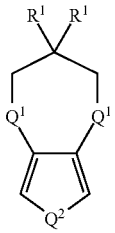

wherein $Q^2$ is S, O, or N—$R^2$ wherein $R^2$ is hydrogen or $C_1$-$C_6$ alkyl; each occurrence of $Q^1$ is independently S or O; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, —$C_1$-$C_6$ alkyl-aryl, —$C_1$-$C_6$ alkyl-O-aryl, or —$C_1$-$C_6$ alkyl-O-aryl. In one embodiment, one $R^1$ is methyl and the other $R^1$ is benzyl, —$C_1$-$C_6$ alkyl-O-phenyl, —$C_1$-$C_6$ alkyl-O-biphenyl, or —$C_1$-$C_6$ alkyl-biphenyl.

Additional conducting monomers include the class of compounds according to structure (XXV):

(XXV)

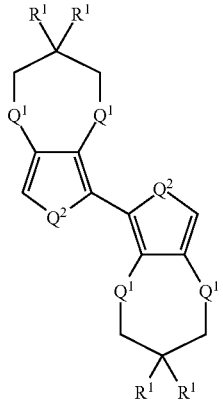

wherein each occurrence of $Q^2$ is independently S, O, or N—$R^2$ wherein $R^2$ is hydrogen or $C_1$-$C_6$ alkyl; each occurrence of $Q^1$ is independently S or O; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl. In one embodiment, one $R^1$ is methyl and the other $R^1$ is —$C_1$-$C_6$ alkyl-O-phenyl or —$C_1$-$C_6$ alkyl-O-biphenyl per geminal carbon center.

Other conducting monomers include the class of compounds according to structure (XXVI):

(XXVI)

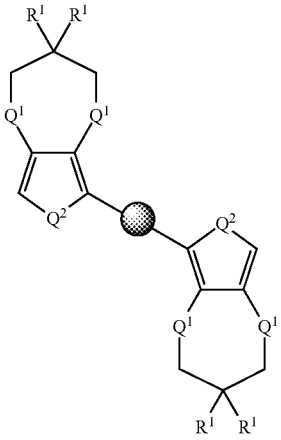

wherein each occurrence of $Q^2$ is independently S, O, or N—$R^2$ wherein $R^2$ is hydrogen or $C_1$-$C_6$ alkyl; each occurrence of $Q^1$ is independently S or O; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, 13 $C_1$-$C_6$ alkyl-O—$C_1$-$C_6$ alkyl, or —$C_1$-$C_6$ alkyl-O-aryl; and

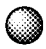

represents an aryl. In one embodiment, one $R^1$ is methyl and the other $R^1$ is —$C_1$-$C_6$ alkyl-O-phenyl or —$C_1$-$C_6$ alkyl-O-biphenyl per geminal carbon center.

Exemplary conducting monomers include the class of compounds according to structure (XXVII):

(XXVII)

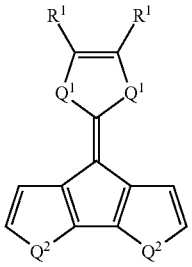

wherein each occurrence of $Q^2$ is independently S, O, or N—$R^2$ wherein $R^2$ is hydrogen or $C_1$-$C_6$ alkyl; each occurrence of $Q^1$ is independently S or O; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl.

Additional conducting monomers include the class of compounds according to structure (XXVIII):

(XXVIII)

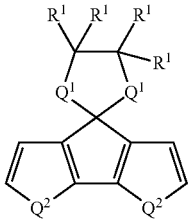

wherein each occurrence of $Q^2$ is independently S, O, or N—$R^2$ wherein $R^2$ is hydrogen or $C_1$-$C_6$ alkyl; each occurrence of $Q^1$ is independently S or O; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl.

Another conducting monomer includes aniline or substituted aniline according to structure (XXIX):

(XXIX)

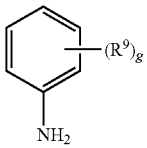

wherein g is 0, 1, 2, or 3; and each occurrence of $R^9$ is independently $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, —$C_1$-$C_6$ alkyl-O-aryl, or N—$R^2$ wherein $R^2$ is hydrogen or $C_1$-$C_6$ alkyl.

The number average molecular weight ($M_n$) of the conducting polymer can be in the range from about 1,000 to about 40,000, specifically from about 2000 to about 30,000.

The template polymerization may be conducted using a single type of conducting monomer to form a homopolymer, or two or more conducting monomer types in a copolymerization process to form a conducting copolymer. As used herein "conducting polymer" is inclusive of conducting homopolymers and conducting copolymers unless otherwise indicated. Furthermore, in one embodiment, the template polymerization may be conducted with a mixture of conducting monomers and nonconducting monomers as long as the resulting copolymer is conductive.

Compounds are described using standard nomenclature. For example, any position not substituted by any indicated group is understood to have its valency filled by a bond as indicated, or a hydrogen atom. A dash ("-") that is not between two letters or symbols is used to indicate a point of attachment for a substituent. For example, "—CHO" is attached through carbon of the carbonyl group.

Unless otherwise indicated, the term "substituted" as used herein means replacement of one or more hydrogens with one or more sub stituents. Suitable sub stituents include, for example, hydroxyl, $C_6$-$C_{12}$ aryl, $C_3$-$C_{20}$ cycloalkyl, $C_1$-$C_{20}$ alkyl, halogen, $C_1$-$C_{20}$ alkoxy, $C_1$-$C_{20}$ alkylthio, $C_1$-$C_{20}$ haloalkyl, $C_6$-$C_{12}$ haloaryl, pyridyl, cyano, thiocyanato, nitro, amino, $C_1$-$C_{12}$ alkylamino, $C_1$-$C_{12}$ aminoalkyl, acyl, sulfoxyl, sulfonyl, amido, or carbamoyl.

As used herein, "alkyl" includes straight chain, branched, and cyclic saturated aliphatic hydrocarbon groups, having the specified number of carbon atoms, generally from 1 to about 20 carbon atoms, greater than 3 for the cyclic. Alkyl groups described herein typically have from 1 to about 20, specifically 3 to about 18, and more specifically about 6 to about 12 carbons atoms. Examples of alkyl include, but are not limited to, methyl, ethyl, n-propyl, isopropyl, n-butyl, 3-methylbutyl, t-butyl, n-pentyl, and sec-pentyl. As used herein, "cycloalkyl" indicates a monocyclic or multicyclic saturated or unsaturated hydrocarbon ring group, having the specified number of carbon atoms, usually from 3 to about 10 ring carbon atoms. Monocyclic cycloalkyl groups typically have from 3 to about 8 carbon ring atoms or from 3 to about 7 carbon ring atoms. Multicyclic cycloalkyl groups may have 2 or 3 fused cycloalkyl rings or contain bridged or caged cycloalkyl groups. Examples of cycloalkyl groups include cyclopropyl, cyclobutyl, cyclopentyl, or cyclohexyl as well as bridged or caged saturated ring groups such as norbornane or adamantane.

As used herein "haloalkyl" indicates both branched and straight-chain alkyl groups having the specified number of carbon atoms, substituted with 1 or more halogen atoms, generally up to the maximum allowable number of halogen atoms ("perhalogenated"). Examples of haloalkyl include, but are not limited to, trifluoromethyl, difluoromethyl, 2-fluoroethyl, and penta-fluoroethyl.

As used herein, "alkoxy" includes an alkyl group as def:ined above with the indicated number of carbon atoms attached through an oxygen bridge (—O—). Examples of alkoxy include, but are not limited to, methoxy, ethoxy, n-propoxy, i-propoxy, n-butoxy, 2-butoxy, t-butoxy, n-pentoxy, 2-pentoxy, 3-pentoxy, isopentoxy, neopentoxy, n-hexoxy, 2-hexoxy, 3-hexoxy, and 3-methylpentoxy.

"Haloalkoxy" indicates a haloalkyl group as defined above attached through an oxygen bridge.

As used herein, the term "aryl" indicates aromatic groups containing only carbon in the aromatic ring or rings. Such aromatic groups may be further substituted with carbon or non-carbon atoms or groups. Typical aryl groups contain 1 or 2 separate, fused, or pendant rings and from 6 to about 12 ring atoms, without heteroatoms as ring members. Where indicated aryl groups may be substituted. Such substitution may include fusion to a 5 to 7-membered saturated cyclic group that optionally contains 1 or 2 heteroatoms independently chosen from N, O, and S, to form, for example, a 3,4-methylenedioxy-phenyl group. Aryl groups include, for example, phenyl, naphthyl, including 1-naphthyl and 2-naphthyl, and bi-phenyl.

As used herein "heteroaryl" indicates aromatic groups containing carbon and one or more heteroatoms chosen from N, O, and S. Exemplary heteroaryls include oxazole, pyridine, pyrazole, thiophene, furan, isoquinoline, and the like. The heteroaryl groups may be substituted with one or more substituents.

As used herein, "halo" or "halogen" refers to fluoro, chloro, bromo, or iodo.

As used herein, "arylene" includes any divalent aromatic hydrocarbon or two or more aromatic hydrocarbons linked by a bond, a heteroatom (e.g., O, S, S(=O), $S(=O)_2$, etc.), a carbonyl group, an optionally substituted carbon chain, a carbon chain interrupted by a heteroatom, and the like.

Poly(3,4-ethylenedioxythiophene) (PEDOT) is a known conducting polymer exhibiting high conductivity, ranging from $10^{-2}$ to $10^{3}$ S/cm. As PEDOT is insoluble in many common solvents, it is prepared by template polymerization with a polyanion, such as poly(styrene sulfonic acid) (PSSA). PSSA is a charge-balancing dopant during polymerization in water which allows for the formation of a colloidal dispersion of poly(3,4-ethylenedioxythiophene)-poly(styrenesulfonic acid) or PEDOT-PSS. PEDOT-PSS is commercially available and has desirable properties, such as high stability in the p-doped form, high conductivity, good film formation, and excellent transparency in the doped state. PEDOT-PSS dispersed in water can be spin-coated to result in transparent films.

The template polymer is typically a polyanion, comprising suitable functional groups to be a counterion to the conducting polymer. Suitable functional groups include sulfonic acid, phosphonic acid, and the like, or a combination thereof. The deprotonated sulfuric acid (sulfonate) serves as the negative ion to counterbalance the positive charge carrier on PEDOT.

Other conducting polymers include the conducting polymer-sulfonated poly(imide) complexes and conducting polymer-sulfonated poly(amic acid) complexes described in U.S. Pat. No. 8,753,542B2 to Sotzing which is incorporated by reference herein in its entirety.

The conducting polymer coating comprises a conducting polymer:template polymer film disposed on the stretchable insulating substrate comprising surface nucleophile derivatized nanoparticles. The conducting polymer:template polymer film can be cast onto the surface of the substrate comprising surface nanoparticles from solutions or dispersions comprising the conducting polymer:template polymer and optionally a surfactant in a suitable solvent using techniques known in the art. Suitable solvents for forming a cast film of conducting polymer:template polymer film depends upon the material. The solvent can be an organic solvent or combination of an organic solvent and water, specifically deionized water. Exemplary organic solvents include dichloromethane (DCM), dimethyl sulfoxide (DMSO), toluene, N,N-dimethyl formamide (DMF), propylene glycol monomethyl ether acetate (PGMEA), propylene glycol monomethyl ether (PGME), acetone, methanol, ethanol, tetrahydrofuran (THF), dimethylacetamide (DMAC), ethyl acetate and trifluoroacetic acid.

Suitable casting or coating processes to form the conducting polymer:template polymer film include drop casting, spin coating, ink jetting, spray coating, dip coating, flow coating, dye casting and the like, or a combination thereof. In one embodiment, the conducting polymer:template polymer film substantially covers a portion of a surface of the stretchable insulating substrate comprising surface nanoparticles, and specifically covers the entire surface. In another embodiment, the conducting polymer:template polymer film is applied to the surface of the stretchable insulating substrate comprising surface nanoparticles in the form of a pattern of any design. Exemplary patterning can be achieved by jetting or a waxing process (wax template), and the like.

After the conducting polymer:template polymer coating has been applied to the surface of the stretchable insulating substrate comprising surface nanoparticles solvent can be removed, if used, and the coating can be annealed. The annealing can be conducted at temperatures of about 80 to about 130° C., specifically about 90 to about 125° C., and yet more specifically about 100 to about 120° C. for as long as needed. Such conditions can be carried out in an oven or other suitable apparatus with or without vacuum or air flow.

The thickness of the conducting polymer:template polymer film can be about to about 40 nm to about 1 micrometer, specifically about to about 80 nm to about 500 nm, and more specifically about 100 nm to about 300 nm.

In an embodiment, the stretchable electrically conductive structure further comprises a conductive organic particle. In an embodiment, the conductive organic particle can be disposed between the stretchable insulating substrate and the conducting polymer:template polymer coating.

The conductive organic particle can be graphene, graphite, a combination of graphene and graphite, carbon nanotubes, buckyballs, "n-type" small molecules, or a combination thereof. Exemplary "n-type" small molecules include those commercially available from Sigma-Aldrich, including 2,9-bis[2-(4-chlorophenyl)ethyl]anthra[2,1,9-def:6,5,10-d'e'f']diisoquinoline-1,3,8,10(2H,9H)tetrone; N,N'-bis(2,5-di-tert-butylphenyl)-3,4,9,10-perylenedicarboximide; 2,9-bis[2-(4-fluorophenyl)ethyl]anthra[2,1,9-def:6,5,10-d'e'f'] ldiisoquinoline-1,3,8,10(2H,9H)tetrone; 2,9-bis[(4-methoxyphenyl)methyl]anthra[2,1,9-def:6,5,10-d'e'f'] diisoquinoline-1,3,8,10(2H,9H)tetrone; N,N'-bis(3-pentyl) perylene-3,4,9,10-bis(dicarboximide); 5,5'''-bis (tridecafluorohexyl)-2,2':5',2":5",2'''-quaterthiophene; 2,2'-bis[4-(trifluoromethyl)phenyl]-5,5'-bithiazole; 5,10,15,20-tetraphenylbisbenz[5,6]indeno[1,2,3-cd:1',2',3'-lm] perylene; 2,9-diheptylanthra[2,1,9-def:6,5,10-d'e'f'] diisoquinoline-1,3,8,10(2H,9H)tetrone; 2,7-dihexylbenzo [1mn][3,8]phenanthroline-1,3,6,8(2H,7H)-tetrone; 4-(2,3-dihydro-1,3-dimethyl-1H-benzimidazol-2-yl)-N,N-dimethylbenzenamine; 4-(1,3-dimethyl-2,3-dihydro-1H-benzoimidazol-2-yl)-N,N-diphenylaniline; N, N'-dimethyl-3,4,9,10-perylenedicarboximide; N,N'-dioctyl-3,4,9,10-perylenedicarboximide; N,N'-dipentyl-3,4,9,10-perylenedicarboximide; [6.6] Diphenyl C62 bis(butyric acid methyl ester); N,N'-diphenyl-3,4,9,10-perylenedicarboximide; 2,9-dipropylanthra[2,1,9-def:6,5,10-d'e'f']diisoquinoline-1,3,8,10(2H,9H)tetrone; N,N'-ditridecylperylene-3,4,9,10-tetracarboxylic diimide; [5,6]-Fullerene-C70; Fullerene-C60; Fullerene-C84; 1',1",4',4"-tetrahydro-di[1,4] methanonaphthaleno[1,2:2',3',56,60:2",3"][5,6]fullerene-C60; 1',4'-Dihydro-naphtho[2',3':1,2][5,6]fullerene-C60; 1,4,5,8-naphthalenetetracarboxylic dianhydride; 1,2,3,4,5,6,7,8-octafluoro-9,10-bis[2-(2,4,6-trimethylphenyl)ethynyl] anthracene; perylene-3,4,9,10-tetracarboxylic dianhydride; [6,6]-phenyl-C61 butyric acid butyl ester; [6,6]-phenyl C61 butyric acid methyl ester; [6,6]-phenyl C71 butyric acid methyl ester; [6,6]-phenyl-C61 butyric acid octyl ester; 7,7,8,8-tetracyanoquinodimethane; 2,3,5,6-tetrafluoro-7,7,8,8-tetracyanoquinodimethane; 1,3,8,10(2H,9H)-tetraone, 2,9-bis(2-phenylethyl)anthra[2,1,9-def:6,5,10-d'e'f']diisoquinoline; 1,3,6,8(2H,7H)-tetraone, 2,7-dicyclohexylbenzo [lmn][3,8]phenanthroline; [6,6]-thienyl C61 butyric acid methyl ester; and the like; or a combination thereof.

In an embodiment, the conductive organic particle used is graphene, graphite, or a combination of graphene and graphite to form a graphene and/or graphite infused stretchable substrate. Pristine graphene can be prepared by exfoliating pristine graphite via sonification in an organic solvent and water to yield graphene flakes. Exemplary organic solvents that can be used in the exfoliating process include alkyl (e.g. n-heptane) and aromatic (e.g. o-dichlorobenzene) solvents.

The total amount of conductive organic particle infused in the stretchable substrate can be about 0.2 to about 20 wt %, specifically about 1 .0 to about 16 wt %, and more specifically about 2.5 to about 13 wt % based on the total weight of the conductive organic particle infused stretchable substrate. The total amount of graphene and/or graphite infused in the stretchable substrate can be about 0.2 to about 20 wt %, specifically about 1.0 to about 16 wt %, and more specifically about 2.5 to about 13 wt % based on the total weight of the conductive organic particle infused stretchable substrate.

In an exemplary embodiment, the conductive organic particle is graphene, graphite, or a combination of graphene and graphite infused, for example, by an interfacial trapping method to form a graphene and/or graphite infused stretchable insulating substrate. The interfacial trapping method generally involves exfoliating pristine graphite via sonification in an organic solvent and water to yield graphene flakes. Exemplary organic solvents that can be used in the exfoliating process include alkyl (e.g. n-heptane) and aromatic (e.g. o-dichlorobenzene) solvents. A stretchable insulating substrate is then exposed to the sonicated mixture and sonicated to infuse the graphene and/or graphite into the stretchable insulating substrate followed by removal of the substrate and drying to form a graphene and/or graphite infused stretchable insulating substrate. In general, the weight/volume ratio of graphite to organic solvent is about 20 mg/mL and the weight/volume ratio of graphite to organic and aqueous solvent is about 10 mg/mL.

The stretchable electrically conducing substrate in the form of a fiber can be used as a fiber, or at least two fibers can be woven, knitted, crocheted, knotted, pressed, or plied to form a multi-filament fiber or fabric. In one embodiment, a plurality of stretchable electrically conducing fibers can be used to manufacture a woven or nonwoven fabric. While these fabrics are generally in the form of a 2-dimensional woven or nonwoven planar sheet, their enhanced flexibility and stretchability permits them to be shaped into 3-dimensional conformations such as a rolled sheet, a folded sheet, a twisted sheet, a coiled sheet, or other configuration.

The advantage of the use of conducting polymer:template polymers is that they can be processed by conventional techniques as opposed to electroplating, etc. Further the conducting polymer:template polymers are all-organic, with the toxicity results of PEDOT-PSS being well known with it having been in development and commercialization for decades. The stretchable electrically conductive structure technology will enable applications for stretchable electronics such as those listed below for sensors, power, and displays. Furthermore, by using PEDOT-PSS, the resulting textile will not be black, but can be a light blue, and therefore can be dyed to other colored states giving the textile further aesthetic quality.

Figure 3:
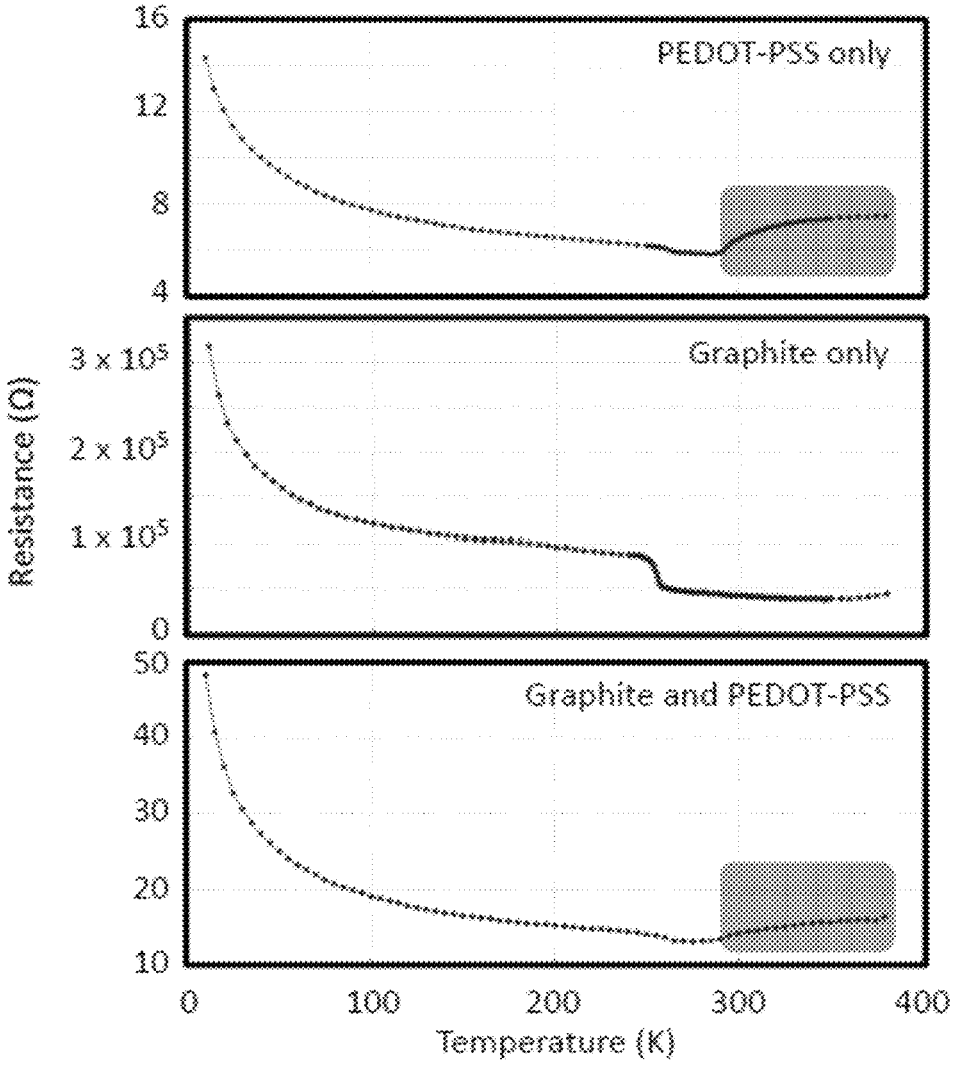
FIG. 3 Resistance versus temperature plot of: 4 wt. % PEDOT-PSS doped fabric (top graph); 7 wt % graphene/graphite infused fabric (middle graph); and 4 wt % PEDOT:PSS doped fabric containing 7 wt % graphene/graphite (bottom graph); the grey box insets of the top and middle graphs shows metallic behavior on a stretchable spandex substrate.

The stretchable electrically conductive structure can exhibit sheet resistance of about 1 to about 50 ohm/□ and more preferably 5 to about 20 ohm/□ wherein the resistance of the material will increase as a function of temperature thereby exhibiting metallic behavior at or approximately 270K. For example, FIG. 3 shows resistance versus temperature plot of a 4 wt. % PEDOT-PSS doped spandex fabric (top graph); a 7 wt % graphene/graphite infused spandex fabric (middle graph); and a 4 wt % PEDOT:PSS doped spandex fabric containing 7 wt % graphene/graphite (bottom graph). The grey box insets of the top and middle graphs shows metallic behavior on a stretchable spandex substrate. Additionally, the PEDOT:PSS coating does not crack when stretched when observed by optical microscopy.

The stretchable electrically conductive structure can be used in various applications in the field of conductive polymer, semiconductor and metal coatings, particularly those applications that are required to withstand folding and twisting without breaking.

The stretchable electrically conductive structure can be an all organic replacement for indium tin oxide (ITO). It can also be used as a component in smart phones, tablets, e-readers; an electrochromic display e.g. in smart cards, smart price tags, and smart labels; used as a copper replacement; thin film batteries and energy storage; transparent solar cells; smart textiles e.g. for consumer products or patient monitoring devices embedded in textiles; vehicle and transportation systems including aerospace e.g. for wiring, electrochromic windows, and deicing applications, also conductive polymers also provide value to vehicles made from inherently nonconductive materials, which require static dissipation, monitoring, heating, or electrochromic characteristics; and wearable computers. The stretchable electrically conductive structure can find use as flexible display materials and other mobile devices which have a significant advantage in terms of durability of traditional devices, and for a new class of devices that are adaptable, or integral to textiles and garments.

Exemplary uses include textile electronics in which electronic functionalities are imparted on a stretchable textile, sensors for biomechanics and biomedicine, medical sensors (e.g. cardiorespiratory sensor), resistive heating devices (e.g. for those suffering from arthritis or for sports therapy), resistance based stretch sensors that can track the movement of a joint, and the like. The sensors can be further equipped with Bluetooth, global positioning systems, or other wireless communication technology to transmit data to fixed and mobile devices. Other applications include embedded conductive polymer wires for carrying current to portable electronic devices, and power based applications in the construction of a fabric based capacitor or battery. Another application is in cell growth by which the surface of the stretchable electrically conductive structure can be stretched allowing for electrostimulated growth of neurons.

The following illustrative examples are provided to further describe the invention and are not intended to limit the scope of the claimed invention.

EXAMPLES

Example 1

Formation of a Stretchable Organic Metal: PEDOT:PSS, No Stretch

One inch by one inch square sample of stretchable insulating fabric of 85% nylon 15% Spandex containing 3% surface area silica nanoparticles (according to X-ray photoelectron spectroscopy ("XPS")) was soaked in two cycles of PEDOT:PSS (CLEVIOS PH1000, an aqueous dispersion of poly(3,4-ethylenedioxythiophene)-poly(styrenesulfonate), PEDOT:PSS ratio 1:2.5 (by weight) and a solid content of 1.0 -1.3%, commercially available from Heraeus CLEVIOS GmbH) (95 wt %)+dimethyl sulfoxide (DMSO) (5 wt %) to achieve a weight percentage of PEDOT:PSS of about 6.02%. Each soaking cycle involved placing the fabric in a container and dropping the PEDOT:PSS on the top until the fabric was saturated. The top side of the fabric sample is referred to as "FRONT". The resulting sample was annealed at 110° C. for 1 hour and then hung to dry.

Sheet resistance was measured for the annealed samples. All resistances were calculated from an I-V curve at room temperature, with a minimum of 10 data points. Electrical data was obtained using a four line probe fabricated in house according to literature design with grooves carved for the leads ensuring a uniform length and spacing was obtained. [R. K. Hiremath, M. K. Rabinal, B. G. Mulimani, Rev. Sci. Instrum. 2006, 77, 126106.] Current was passed through the outer two electrodes, while the inner two measured voltage. Sheet resistance was calculated based on the relationship Rs=R(w/l) where w is the width of the sample (2.5 cm), and 1 is the distance between the leads (0.35 cm). [Hiremath, 2006] Two current sources were used, a Keithley 224 Programmable for small current (I max=101.1×10−3 A), Power Supply 3630 for high current I max=10 A, and a 196 system DMA was used to measure the voltage. The results are shown in Table 1.

TABLE 1

| | Sheet Resistance (Ω/sq) |
|---|---|
| Front - | 2.651 |
| Front \| | 6.676 |
| Back - | 7.455 |
| Back \| | 4.153 |

Example 2

Formation of a Stretchable Organic Metal: PEDOT:PSS, Preliminary Stretch

One inch by one inch square samples of stretchable insulating fabric of 90% polyester 10% Spandex having 3% surface area silica nanoparticles (according to XPS) were soaked under stretch in two cycles of PEDOT:PSS (CLEVIOS PH1000) (95 wt %)+DMSO (5wt %). A first sample was soaked under a 2-way stretch (120%) to achieve a weight percentage of PEDOT:PSS of about 7.91%. A second sample was soaked under a 4-way stretch (120%) to achieve a weight percentage of PEDOT:PSS of about 5.54%. As in Example 1, each soaking cycle involved placing the fabric in a container and dropping the PEDOT:PSS on the top until the fabric was saturated, however for Example 2 the samples were soaked while stretched. The top side of the fabric sample is referred to as "FRONT". The resulting samples were annealed at 110° C. for 1 hour under stretch.

Sheet resistance was measured for the annealed samples as set out in Example 1; the results are shown in Table 2.

TABLE 2

| | Sheet Resistance (Ω/sq) 2-way stretch 120%, 7.91% PEDOT:PSS | Sheet Resistance (Ω/sq) 4-way stretch 120%, 5.54% PEDOT:PSS |
|---|---|---|
| Front - | 12.50 | 10.41 |
| Front \| | 34.55 | 20.22 |
| Back - | 36.08 | 18.33 |
| Back \| | 14.57 | 17.17 |

Example 3

Formation of a Stretchable Organic Metal: PEDOT:PSS, Preliminary Stretch

A one inch by one inch square sample of stretchable insulating fabric of 90% polyester 10% Spandex having 3% surface area silica nanoparticles (according to XPS) was soaked under stretch in two cycles of PEDOT:PSS (CLEVIOS PH1000) (95 wt %)+DMSO (5 wt %) to achieve a weight percentage of PEDOT:PSS of about 5.23%. As in Example 1, each soaking cycle involved placing the fabric in a container and dropping the PEDOT:PSS on the top until the fabric was saturated, however for Example 3 the sample was soaked while stretched. The top side of the fabric sample is referred to as "FRONT". The resulting sample was annealed at 110° C. for 1 hour and allowed to relax during annealing and then hung to dry.

Sheet resistance was measured on the annealed sample as set out in Example 1; the results are shown in Table 3.

TABLE 3

| | Sheet Resistance (Ω/sq) |
|---|---|
| Front - (stretch direction) | 2.592 |
| Front \| | 8.245 |
| Back - | 6.676 |
| Back \| | 3.474 |

Example 4

Formation of a Stretchable Organic Metal: PEDOT:PSS; Plasma Treatment

A one inch by one inch square sample of stretchable insulating fabric of 90% polyethylene terephthalate 10% Spandex having 3% surface area silica nanoparticles (according to XPS) was plasma treated for five seconds and then soaked in one cycle of PEDOT:PSS (CLEVIOS PH1000) (95 wt %)+DMSO (5 wt %) to achieve a weight percentage of PEDOT:PSS of about 3.63% after annealing for 1 hour at 110° C. The resulting PEDOT:PSS film thickness was 204±167 nm as determined by scanning electron microscopy (SEM). The sample exhibited a sheet resistance from four-probe measurement of 17.17±3.53 Ω/sq. All resistances were calculated from an I-V curve at room temperature, with a minimum of 10 data points. Electrical data was obtained using a four line probe fabricated in house according to literature design with grooves carved for the leads ensuring a uniform length and spacing was obtained. [R. K. Hiremath, M. K. Rabinal, B. G. Mulimani, Rev. Sci. Instrum. 2006, 77, 126106.] Current was passed through the outer two electrodes, while the inner two measured voltage. Sheet resistance was calculated based on the relationship Rs=R(w/l) where w is the width of the sample (2.5 cm), and 1 is the distance between the leads (0.35 cm). [Hiremath, 2006] Two current sources were used, a Keithley 224 Programmable for small current (I max=101.1×10 −3 A), Power Supply 3630 for high current I max=10 A, and a 196 system DMA was used to measure the voltage.

A similar sample of 90% PET 10% Spandex stretchable insulating fabric having 3% surface area silica nanoparticles (according to XPS) was plasma treated for twenty seconds and then soaked in two cycles of PEDOT:PSS (CLEVIOS PH1000) (95 wt %)+DMSO (5 wt %) to achieve a weight percentage of PEDOT:PSS of about 3.84% after annealing for 1 hour at 110° C. after each soak. The sample exhibited a sheet resistance from a four-probe measurement of 14.36±2.89 Ω/sq.

Example 5

Formation of a Stretchable Organic Metal: PEDOT:PSS, Plasma Treatment

A one inch by one inch square sample of stretchable insulating fabric of 85% nylon 15% Spandex having 3% surface area silica nanoparticles (according to XPS) was plasma treated for five seconds and then soaked in one cycle of PEDOT:PSS (CLEVIOS PH1000) (95 wt %)+DMSO (5wt %), annealed at 110° C. for 1 hour to achieve a weight percentage of PEDOT:PSS of about 4.40%. The resulting PEDOT:PSS film thickness was 225±106 nm as determined by scanning electron microscopy (SEM). The sample exhibited a sheet resistance from four-probe measurement of 12.21±0.72 Ω/sq.

A similar sample of 85% nylon 15% Spandex stretchable insulating fabric having 3% surface area silica nanoparticles (according to XPS) was plasma treated for sixty seconds and then soaked in two cycles of PEDOT:PSS (CLEVIOS PH1000) (95 wt %)+DMSO (5 wt %), annealed at 110° C. for 1 hour to achieve a weight percentage of PEDOT:PSS of about 6.96%. The sample exhibited a sheet resistance from a four-probe measurement of 4.80±0.85 Ω/sq.

Example 6

Formation of a Stretchable Organic Metal: PEDOT:PSS, Graphene, and Comparative Stretchable Fabric with Graphene Alone A one inch by one inch square sample of stretchable insulating fabric of 90% PET 10% Spandex having 3% surface area silica nanoparticles (according to XPS) was plasma treated for twenty seconds, sonicated in graphite/heptane/water for 1 hour, dried in an over, and then soaked in two cycles of PEDOT:PSS (CLEVIOS PH1000) (95 wt %)+DMSO (5 wt %), annealed at 110° C. for 1 hour to achieve a weight percentage of graphite of 5.96% and PEDOT:PSS of 7.15%. The sample exhibited a sheet resistance from four-probe measurement of 3.02 Ω/sq.

A comparative sample of 90% PET 10% Spandex stretchable insulating fabric having 3% surface area silica nanoparticles (according to XPS) was plasma treated for twenty seconds sonicated in graphite/heptane/water for 1 hour, dried in an over to achieve a weight percentage of conductor of about 9.12%. The sample exhibited a sheet resistance from a four-probe measurement of 9071.43 Ω/sq.

Example 7

Phase Segregation of PEDOT and PSS from the Outer Surface of PEDOT:PSS Films

Figure 2:
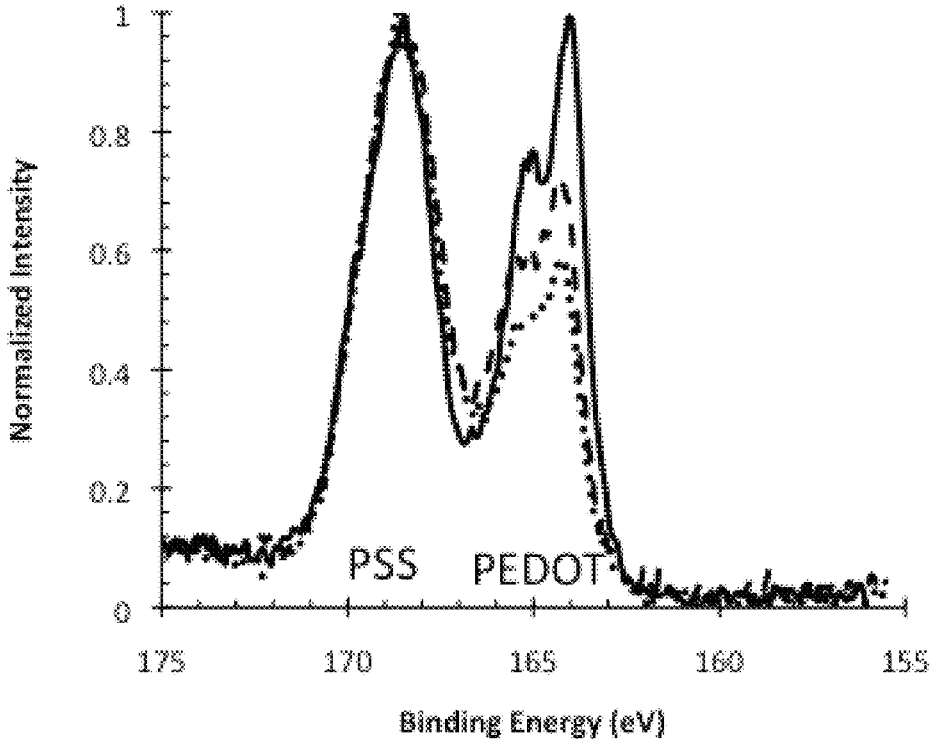
FIG. 2 contains XPS results for PEDOT-PSS films on various substrates containing nucleophile derivatized nanoparticles (silica) compared to a control substrate free of nucleophile derivatized nanoparticles.

The phenomenon of PEDOT and PSS phase segregation as observed on the outer surface of the PEDOT-PSS films was analyzed by x-ray photoelectron spectroscopy (XPS). FIG. 2 discloses three XPS traces for PEDOT-PSS films on (dotted line) a control sample of electrospun PET fibers of 3 micrometer diameter with 150 nm thick PEDOT-PSS film, (dashed line) PET electrospun mat of same fiber diameter having silica nanoparticles with 150 nm thick film of PEDOT-PSS, and (solid line) PEDOT-PSS film of 130 nm thickness on synthetic leather fibers having silica nanoparticles. As shown in FIG. 2, the two bands between 162 and 166 eV are the spin-split doublet S(2P), S($2p_{1/2}$) and S ($2p_{3/2}$), bands from the sulfur in PEDOT. [X. Crispin, S. Marciniak, W. Osikowicz, G. Zotti, A. W. D. van der Gon, F. Louwet, M. Fahlman, L. Groenendaal, F. De Schryver, W. R. Salaneck, *J. Polym. Sci. Part B Polym. Phys.* 2003, 41, 2561; U. Voigt, W. Jaeger, G. H. Findenegg, R. v. Klitzing, *J. Phys. Chem. B* 2003, 107, 5273] The energy splitting is ~1.2 eV, the respective intensities have a ratio of 1:2 and the components typically have the same full width at half maximum and shape. In the case of the sulfur S2p from PSS, the binding energy bands are found at higher energy between 166 and 172 eV. The broad peak is composed of the spin-split doublet peaks. This broadening effect is due to the sulfonate group existing in both the neutral and anionic state. Therefore, there is a broad distribution of different energies in this high molecular weight polymer. The same applies to PEDOT although the number of charged and neutral species are not as large in number. The PEDOT:PSS ratio was calculated by measuring the integral area ratio of peaks assigned to PEDOT and PSS. The ratio of PEDOT to PSS increased from 1 to 1.95 for the control consisting of PET fibers without silica having a coating of PEDOT-PSS to a ratio of 1 to 1.2 for PET fibers containing silica nanoparticles translating to an 80% reduction of PSS at the surface. The PEDOT to PSS ratio of 1 to 1.95 of the control sample consisting of PEDOT-PSS film coated on PET fibers without silica agrees well with the manufacture specifications for the Clevios PH1000 [Coating Guide Clevios™ P Formulations. 1-12 (2012) at http://www.heraeus-clevios.com/media/web-media_local/media/datenblaetter/Clevios_P_coating guide-_guide_08-03-18jb2.pdf] indicating there is no phase segregation in the absence of silica.

These results indicate PEDOT:PSS has undergone phase segregation forming a PEDOT rich surface to the PEDOT-PSS film likely due to hydrogen bonding between the sulfonate anions on PSS and the hydroxyl rich surface of silica.[S.-J. Wang, Y.-J. Choi, S. C. Gong, Y.-H. Kim, H.-H. Park, Mol. Cryst. Liq. Cryst. 2012, 568, 179] The phase segregation was not significant enough to induce high level ordering or crystal growth as the microstructure mostly remained amorphous based on glancing angle X-ray measurements. This could likely be due to PSS as previous reports did not observe PEDOT crystalline formation until it was removed. [Wang, 2012; N. Kim, S. Kee, S. H. Lee, B. H. Lee, Y. H. Kahng, Y.-R. Jo, B.-J. Kim, K. Lee, Adv. Mater. 2014, 26, 2268; D. Alemu, H.-Y. Wei, K.-C. Ho, C.-W. Chu, Energy Environ. Sci. 2012, 5, 9662] Since inter and intra-charge hopping is believed to be the dominant conduction mechanism in conducting polymers [A. Aleshin, R. Kiebooms, R. Menon, A. J. Heeger, *Synth. Met.* 1997, 90, 61] hydrogen bonding interactions leading to phase segregation between PEDOT and PSS enables more interchain interaction between the conducting PEDOT domains. Hence, the energy barrier for charge hopping is lowered leading to better charge transfer among the PEDOT chains. [D. Alemu, H.-Y. Wei, K.-C. Ho, C.-W. Chu, Energy Environ. Sci. 2012, 5, 9662]

Example 8

Washability Studies

Sample Preparation: PEDOT-PSS (Conductive Polymer) was coated onto nonwoven PET synthetic leather (having 3%±1% surface area silica nanoparticles according to XPS) of 1 mm thickness using different techniques such screen printing, roller printing and brush printing. The sample textile size for coating was 1"×1". 1 mm width line was laid onto the center of the fabric and then dried at 110° C. for 1 hour. The weight of the sample before and after the coating was measured using a microbalance to give the wet mass of PEDOT-PSS on the fabric. Water content in the printing solution was calculated from TGA which was used to calculate the weight of dry PEDOT-PSS on fabric. The resistance of the samples was measured using 4 line probe technique immediately after drying.

Washing durability: Step 1. Commercially available TIDE laundry detergent commercially available from Procter & Gamble was used for studying the washability of the fabric. 1%w/w solution of TIDE in DI water was prepared. Separate solution of DI water was used as control. Step 2. For hydrophobic treated fabrics, both sides of the fabric were sprayed with Scotchgard™ Fabric & Upholstery Protector (commercially available from 3M) and allowed to dry at room temperature for 6 hours. Step 3. The fabrics were stirred in these solutions (50 ml) to simulate agitation of the fabric for 5 min. The fabrics were then dried at 60° C. overnight. The resistances of the fabric before and after the wash were measured. Step 4. The sheet resistance was measured using a four line probe method before and after washing for samples without hydrophobic treatment. For the hydrophobic treated fabrics, both ends of the conductive wires were cut after each wash. Silver paste was applied to the ends followed by annealing at 60° C. for 30 min in order to make connections to the power source. The resistance was measured and the sheet resistance was calculated based on the dimension of the wires. Scotchgard™ was applied again following the same procedure in Step 2 before the next washing cycle.

Figure 4:
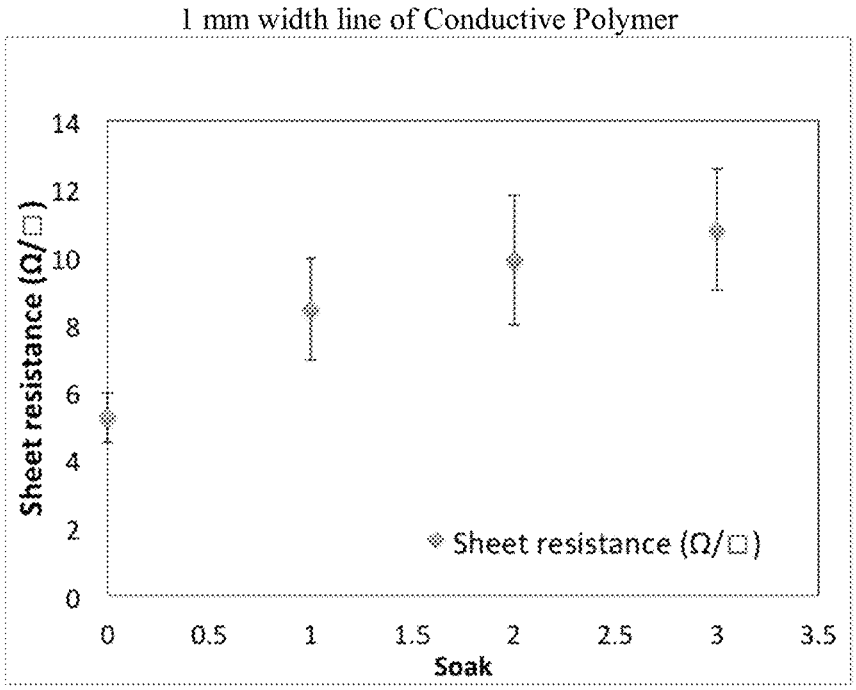
FIG. 4 Sheet resistance versus soak plot for samples having a 1 mm width line of PEDOT-PSS, where the samples have undergone a washing treatment.
Figure 5:
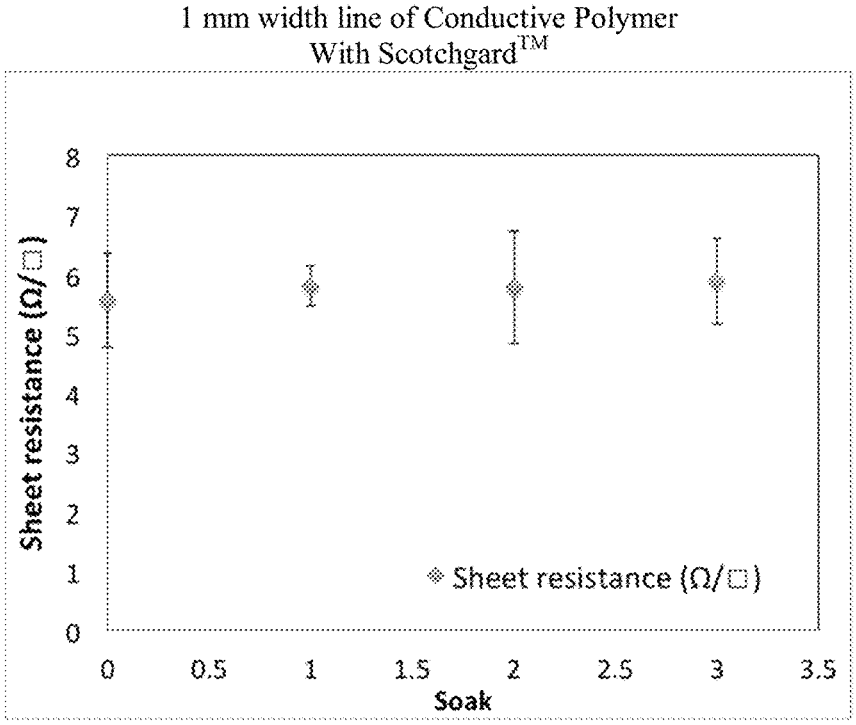
FIG. 5 Sheet resistance versus soak plot for samples having a 1 mm width line of PEDOT-PSS and Scotchgard™ treatment, where the samples have undergone a washing treatment.

FIG. 4 illustrates the sheet resistance (ohm/□) of samples having a 1 mm width line of Conductive Polymer, where the samples have undergone a washing treatment ("Soak" on the x-axis). FIG. 5 illustrates the sheet resistance (ohm/□) of samples having a 1 mm width line of Conductive Polymer and Scotchgard™ treatment, where the samples have undergone a washing treatment ("Soak" on the x-axis). As shown by the results, the samples were washable, i.e., the electrical conductivity of the sample was substantially retained after the washing treatment. Such results are surprising as it was not previously known that a salt-polymer, e.g. a conductive polymer consisting of positively charged polythiophene and a negatively charged polystyrene sulfonate (PEDOT-PSS), would be able to withstand a wash cycle in the presence of laundry detergent, or that it could be stabilized using Scotchgard™. Rather, it would have been expected that a charged species such as PEDOT-PSS would either dissipate or there would be ion exchange with the surfactant of the laundry detergent to diminish electrical properties.

Although Example 8 was conducted using nonwoven PET synthetic leather, the stretchable electrically conductive structure exhibits similar washability.

Example 9

Organic Antennae

Figure 6:
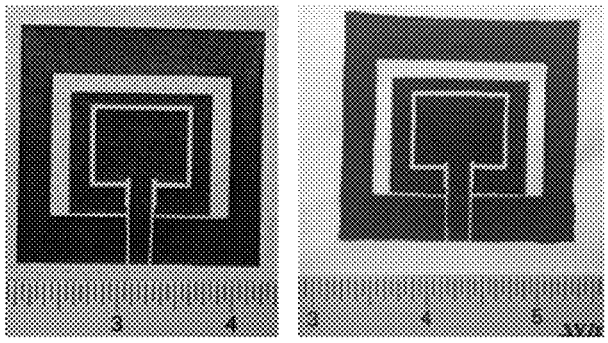
FIG. 6 Images of PEDOT:PSS screen printed on synthetic leather (left) and Spandex (right) prepared as antennae.

PEDOT-PSS (CLEVIOS PH1000) (95 wt %)+DMSO (5 wt %)) was printed on samples of synthetic leather and on samples of Spandex, each having approximately 3% (±1%) surface area silica nanoparticles (according to XPS), using a mask (negative) having a geometry of a dual-band coplanar waveguide (CPW) antenna as set out in FIG. 1 of Langley, Electronics Letters 2009. Screen printed antennae are shown in FIG. 6 synthetic leather (left) and Spandex (right)) where the dark regions are PEDOT-PSS.

Figure 7:
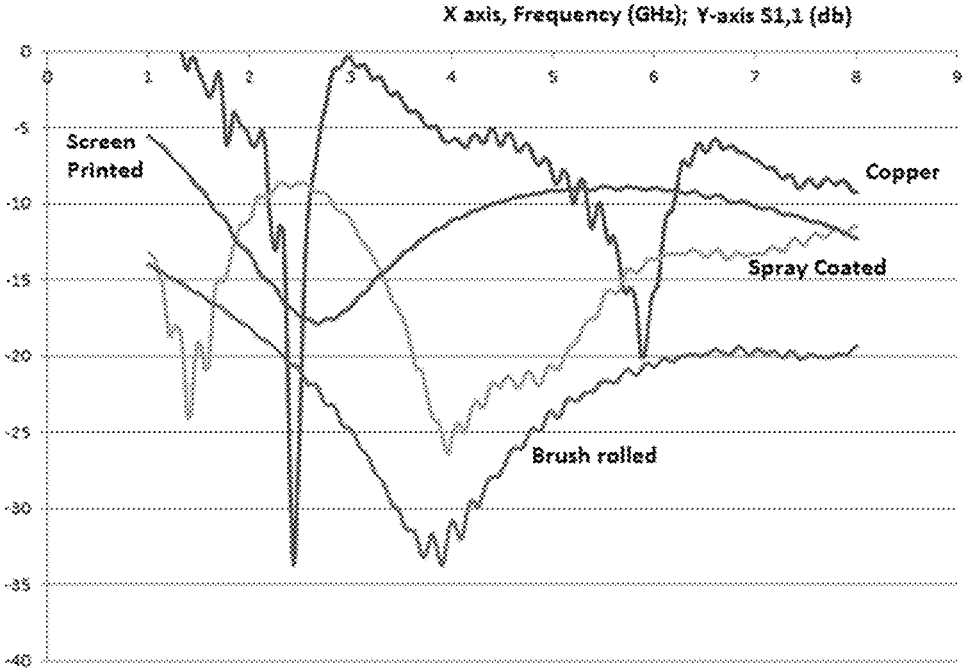
FIG. 7 Organic fabric antennae signal frequencies compared to copper.

Different processing procedures produced different frequencies in comparison to copper antenna as shown in FIG. 7. The traces in FIG. 7 are for the synthetic leather samples prepared into antennae by three different processes: "Screen Printed", "Spray Coated", and "Brush Rolled". As shown in the figure, PEDOT-PSS that was screen printed yields a signal at Bluetooth® frequency. Other antennae can be patterned to have different frequencies (2.5 GHz "Bluetooth®", 6 GHz Global Positioning System (GPS) frequencies, and the like), along with tailoring of the electrical conductivity of the organic metal and use of secondary dopants to optimize electrical conductivity.

The singular forms "a," "an," and "the" include plural referents unless the context clearly dictates otherwise. The endpoints of all ranges directed to the same characteristic or component are independently combinable and inclusive of the recited endpoint.

While the invention has been described in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that aspects of the invention can include only some of the described embodiments. Accordingly, the invention is not to be seen as limited by the foregoing description, but is only limited by the scope of the appended claims.

What is claimed is:

1. A stretchable electrically conductive structure, comprising a stretchable insulating substrate comprising nucleophile derivatized nanoparticles located at the surface of the stretchable insulating substrate, wherein the stretchable insulating substrate is a fiber or fabric; and a conducting polymer:template polymer coating disposed on at least a portion of a surface of the stretchable insulating substrate through which a chemical bond forms between at least one anion of the template polymer and nucleophile derivatized nanoparticles located at the surface of the stretchable insulating substrate;

optionally wherein the stretchable electrically conductive structure comprises a conductive organic particle disposed between the stretchable insulating substrate and the conducting polymer:template polymer coating.

2. The stretchable electrically conductive structure of claim 1, wherein the stretchable insulating substrate is a woven fabric.

3. The stretchable electrically conductive structure of claim 1, wherein the stretchable insulating substrate is a polyester-polyurethane copolymer and optionally further comprises polyacrylic, polyamide, polycarbonate, polyether, polyester, polyethylene, polyimide, polyurethane, polyurea, polythiourea, polysiloxane, polyisoprene, polybutadiene, polyethylene oxide, polylactic acid, blends thereof or copolymers thereof.

4. The stretchable electrically conductive structure of claim 1, wherein the nucleophile derivatized nanoparticles is silicon dioxide ($SiO_2$), titanium dioxide ($TiO_2$), aluminum oxide, calcium oxide, amine functionalized nanoparticles, or a combination thereof.

5. The stretchable electrically conductive structure of claim 1, wherein the nanoparticles have a particle size of about 1 nanometer (nm) to about 1000 nm.

6. The stretchable electrically conductive structure of claim 1, wherein the nanoparticles are present on the surface of the stretchable insulating substrate in an amount of 0.05 to about 5% area relative to the total surface area of the stretchable insulating substrate.

7. The stretchable electrically conductive structure of claim 1, wherein the nanoparticles are present in the stretchable insulating substrate in an amount of about 0.05 to about 5 wt % based on the total weight of the stretchable insulating substrate.

8. The stretchable electrically conductive structure of claim 1, wherein the stretchable insulating substrate has a thickness of about 100 nm to about 5 mm.

9. The stretchable electrically conductive structure of claim 1, wherein the conducting polymer of the conducting polymer:template polymer comprises units of a conducting monomer wherein the conducting monomer is thiophene, substituted thiophene, 3,4-ethylenedioxythiophene, thieno[3,4-b]thiophene, substituted thieno[3,4-b]thiophene, dithieno[3,4-b:3',4'-d]thiophene, thieno[3,4-b]furan, substituted thieno[3,4-b]furan, bithiophene, substituted bithiophene, pyrrole, substituted pyrrole, phenylene, substituted phenylene, naphthalene, substituted naphthalene, biphenyl and terphenyl and their substituted versions, phenylene vinylene, substituted phenylene vinylene, aniline, substituted aniline, a monomer of any one of structures (I)-(XXIX):

(I)

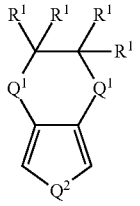

wherein each occurrence of $Q^1$ is independently S or O; $Q^2$ is S, O, or N—$R^2$ wherein $R^2$ is hydrogen or $C_1$-$C_6$ alkyl; and each occurrence of $R^1$ is independently hydrogen, $C_1$-$C_{12}$ alkyl, $C_1$-$C_{12}$ alkyl-OH, $C_1$-$C_{12}$ haloalkyl, $C_1$-$C_{12}$ alkoxy, $C_1$-$C_{12}$ haloalkoxy, aryl,—$C_1$-$C_6$ alkyl-O—$C_1$-$C_6$ alkyl, or —$C_1$-$C_6$ alkyl-O-aryl;

(II)

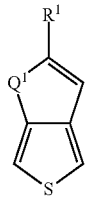

(III)

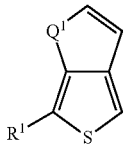

(IV)

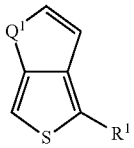

wherein $Q^1$ is S, O, or Se; and $R^1$ is hydrogen, $C_1$-$C_{12}$ alkyl, $C_1$-$C_{12}$ haloalkyl including perfluoroalkyl, $C_1$-$C_{12}$ alkoxy, $C_1$-$C_{12}$ haloalkoxy, aryl, —$C_1$-$C_6$ alkyl-O-$C_1$-$C_6$ alkyl, or —$C_1C_6$ alkyl-O-aryl;

(V)

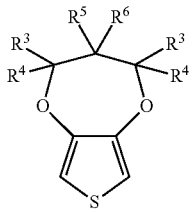

wherein each instance of $R^3$, $R^4$, $R^5$, and $R^6$ independently is hydrogen; optionally substituted $C_1$-$C_{20}$ alkyl, $C_1$-$C_{20}$ haloalkyl, aryl, $C_1$-$C_{20}$ alkoxy, $C_1$-$C_{20}$ haloalkoxy, aryloxy, —$C_1$-$C_{10}$ alkyl-O—$C_1$-$C_{10}$ alkyl, —$C_1$-$C_{10}$ alkyl-O-aryl, —$C_1$-$C_{10}$ alkyl-aryl; or hydroxyl;

(VI)

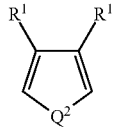

wherein $Q^2$ is S, O, or N—$R^2$ wherein $R^2$ is hydrogen or $C_1$-$C_6$ alkyl; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(VII)

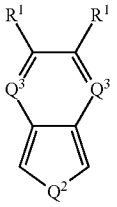

wherein $Q^2$ is S, O, or N—$R^2$ wherein $R^2$ is hydrogen or $C_1$-$C_6$ alkyl; each occurrence of $Q^3$ is independently CH or N; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(VIII)

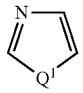

wherein $Q^1$ is S or O;

(IX)

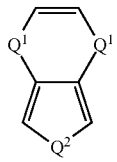

wherein $Q^2$ is S, O, or N—$R^2$ wherein $R^2$ is hydrogen or $C_1$-$C_6$ alkyl; and each occurrence of $Q^1$ is independently S or O;

(X)

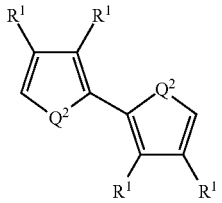

wherein each occurrence of $Q^2$ is independently S, O, or N—$R^2$ wherein $R^2$ is hydrogen or $C_1$-$C_6$ alkyl; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XI)

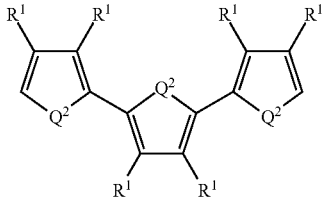

wherein each occurrence of $Q^2$ is independently S, O, or N—$R^2$ wherein $R^2$ is hydrogen or $C_1$-$C_6$ alkyl; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XII)

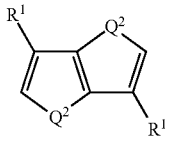

wherein each occurrence of $Q^2$ is independently S, O, or N—$R^2$ wherein $R^2$ is hydrogen or $C_1$-$C_6$ alkyl; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XIII)

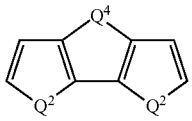

wherein each occurrence of $Q^2$ is independently S, O, or N—$R^2$ wherein $R^2$ is hydrogen or $C_1$-$C_6$ alkyl; $Q^4$ is $C(R^1)_2$, S, O, or N—$R^2$; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XIV)

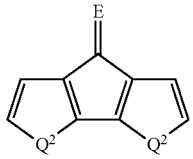

wherein each occurrence of $Q^2$ is independently S, O, or N—$R^2$ wherein $R^2$ is hydrogen or $C_1$-$C_6$ alkyl; and E is O or $C(R^7)_2$, wherein each occurrence of $R^7$ is an electron withdrawing group;

(XV)

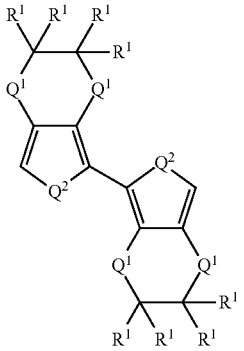

wherein each occurrence of $Q^1$ is independently S or O; each occurrence of $Q^2$ is independently S, O, or N—$R^2$ wherein $R^2$ is hydrogen or $C_1$-$C_6$ alkyl; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XVI)

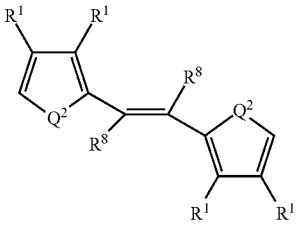

wherein each occurrence of $Q^2$ is independently S, O, or N—$R^2$ wherein $R^2$ is hydrogen or $C_1$-$C_6$ alkyl; each occurrence of $R^1$ is independently hydrogen, $C_1$-$C_{12}$ alkyl, $C_1$-$C_{12}$ haloalkyl, $C_1$-$C_{12}$ alkoxy, —$C_1$-$C_{12}$ haloalkoxy, aryl, $C_1$-$C_6$ alkyl-O—$C_1$-$C_6$ alkyl, or —$C_1$-$C_6$ alkyl-O-aryl; and each occurrence of $R^8$ is hydrogen, $C_1$-$C_6$ alkyl, or cyano;

(XVII)

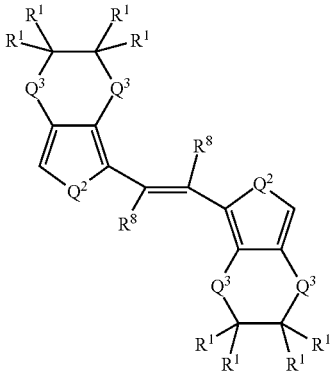

wherein each occurrence of $Q^3$ is independently $CH_2$, S, or O; each occurrence of $Q^2$ is independently S, O, or N—$R^2$ wherein $R^2$ is hydrogen or $C_1$-$C_6$ alkyl; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl; and each occurrence of $R^8$ is hydrogen, $C_1$-$C_6$ alkyl, or cyano;

(XVIII)

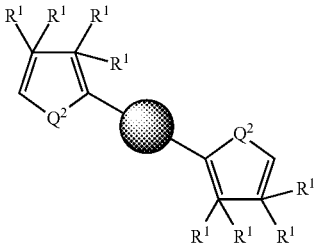

wherein each occurrence of $Q^2$ is independently S, O, or N—$R^2$ wherein $R^2$ is hydrogen or $C_1$-$C_6$ alkyl; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl; and

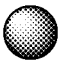

represents an aryl;

(XIX)

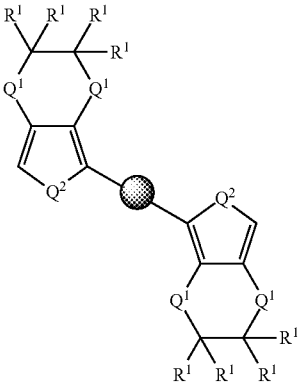

wherein each occurrence of $Q^1$ is independently S or O; each occurrence of $Q^2$ is independently S, O, or N—$R^2$ wherein $R^2$ is hydrogen or $C_1$-$C_6$ alkyl; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl; and

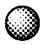

represents an aryl;

(XX)

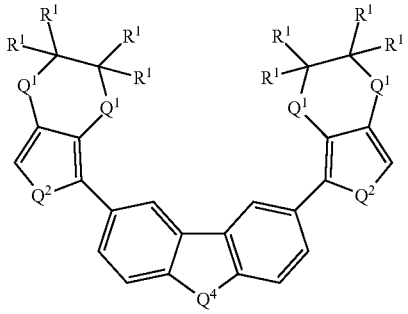

wherein each occurrence of $Q^1$ is independently S or O; each occurrence of $Q^2$ is independently S, O, or N—$R^2$ wherein $R^2$ is hydrogen or $C_1$-$C_6$ alkyl; $Q^4$ is $C(R^1)_2$, S, O, or N—$R^2$; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XXI)

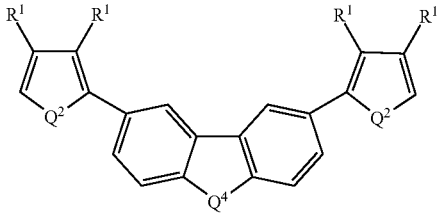

wherein each occurrence of $Q^2$ is independently S, O, or N—$R^2$ wherein $R^2$ is hydrogen or $C_1$-$C_6$ alkyl; $Q^4$ is $C(R^1)_2$, S, O, or N—$R^2$; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XXII)

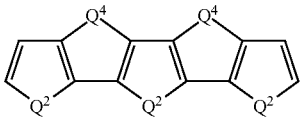

wherein each occurrence of $Q^2$ is independently S, O, or N—$R^2$ wherein $R^2$ is hydrogen or $C_1$-$C_6$ alkyl; each occurrence of $Q^4$ is $C(R^1)_2$, S, O, or N—$R^2$; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XXIII)

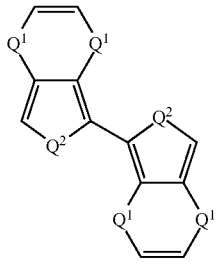

wherein each occurrence of $Q^2$ is independently S, O, or N—$R^2$ wherein $R^2$ is hydrogen or $C_1$-$C_6$ alkyl; and each occurrence of $Q^1$ is independently S or O;

(XXIV)

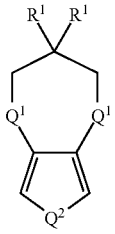

wherein $Q^2$ is S, O, or N—$R^2$ wherein $R^2$ is hydrogen or $C_1$-$C_6$ alkyl; each occurrence of $Q^1$ is independently S or O; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, —$C_1$-$C_6$ alkyl-aryl, —$C_1$-$C_6$ alkyl-O-aryl, or —$C_1$-$C_6$ alkyl-O-aryl;

(XXV)

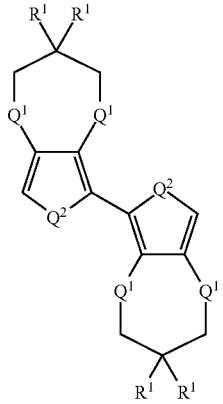

wherein each occurrence of $Q^2$ is independently S, O, or N—$R^2$ wherein $R^2$ is hydrogen or $C_1$-$C_6$ alkyl; each occurrence of $Q^1$ is independently S or O; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XXVI)

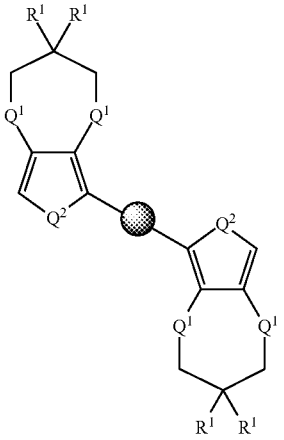

wherein each occurrence of $Q^2$ is independently S, O, or N—$R^2$ wherein $R^2$ is hydrogen or $C_1$-$C_6$ alkyl; each occurrence of $Q^1$ is independently S or O; each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl; and

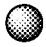

represents an aryl;

(XXVII)

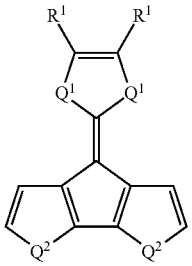

wherein each occurrence of $Q^2$ is independently S, O, or N—$R^2$ wherein $R^2$ is hydrogen or $C_1$-$C_6$ alkyl; each occurrence of $Q^1$ is independently S or O; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XXVIII)

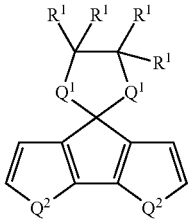

wherein each occurrence of $Q^2$ is independently S, O, or N—$R^2$ wherein $R^2$ is hydrogen or $C_1$-$C_6$ alkyl; each occurrence of $Q^1$ is independently S or O; and each occurrence of $R^1$ is independently hydrogen, $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, or —$C_1$-$C_6$ alkyl-O-aryl;

(XXIX)

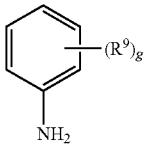

wherein g is 0, 1, 2, or 3; and each occurrence of $R^9$ is independently $C_1$-$C_{12}$ alkyl, $C_1$-$C_{12}$ haloalkyl, $C_1$-$C_{12}$ alkoxy, $C_1$-$C_{12}$ haloalkoxy, aryl, —$C_1$-$C_6$ alkyl-O—$C_1$-$C_6$ alkyl, —$C_1$-$C_6$ alkyl-O-aryl, or N—$R^2$ wherein $R^2$ is hydrogen or $C_1$-$C_6$ alkyl;

or a combination thereof; and the template polymer is a polyanion acting as a counterion for a conducting polymer.

10. The stretchable electrically conductive structure of claim 1, wherein the template polymer comprises sulfonic acid groups, phosphoric acid groups, or a combination thereof.

11. The stretchable electrically conductive structure of claim 1, wherein the conducting polymer:template polymer coating is a film or a pattern on the surface of the stretchable insulating substrate.

12. The stretchable electrically conductive structure of claim 1, wherein the conducting polymer:template polymer coating has a thickness of about 40 nm to about 1 micrometer.

13. The stretchable electrically conductive structure of claim 1, wherein the conductive organic particle is graphene, graphite, a combination of graphene and graphite, carbon nanotubes, buckyballs, "n-type" small molecules, or a combination thereof.

14. The stretchable electrically conductive structure of claim 1, wherein the conductive organic particle is present in an amount of about 0.2 to about 20 wt % based on the total weight of the stretchable electrically conductive structure.

15. The stretchable electrically conductive structure of claim 1, having one or more of the following:

sheet resistance of about 1 to about 50 ohm/□; and conductivity greater than 5000 S/cm; and exhibit an increase in resistance as a function of temperature at a temperature above 270K; and substantially retains its original electrical conductive properties after undergoing a washing treatment, which may include laundry detergent; and a hydrophobic treatment.

16. The stretchable electrically conductive structure of claim 1, wherein the conducting polymer:template polymer is PEDOT:PSS.

17. An article comprising the stretchable electrically conductive structure of claim 1.

18. The article of claim 17, is a flexible, all organic antennae.

19. A method of making a stretchable electrically conductive structure, comprising providing a stretchable insulating substrate comprising nucleophile derivatized nanoparticles located at the surface of the stretchable insulating substrate, wherein the stretchable insulating substrate is a fiber or fabric;

forming a conducting polymer:template polymer coating on at least a portion of a surface of the stretchable insulating substrate to form a stretchable electrically conductive structure, optionally further wherein the stretchable insulating substrate is plasma treated before the forming the conducting polymer:template polymer coating.

20. The method of claim 19, wherein the conducting polymer:template polymer coating is formed using a casting process, tape casting, flow coating, spray coating, spin coating, ink jetting, dip coating, or a combination thereof.

21. The method of claim 19, further comprising, disposing a conductive organic particle on at least a portion of a surface of the stretchable insulating substrate.

* * * * *